US012760961B2

(12) United States Patent
Lee et al.

(10) Patent No.: US 12,760,961 B2
(45) Date of Patent: Oct. 13, 2026

(54) REFRIGERATOR

(71) Applicant: SAMSUNG ELECTRONICS CO., LTD., Suwon-si (KR)

(72) Inventors: Yeongjun Lee, Suwon-si (KR); Kyoungsun Park, Suwon-si (KR); Huido Park, Suwon-si (KR); Minseob Yook, Suwon-si (KR); Jisick Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 501 days.

(21) Appl. No.: 18/222,060

(22) Filed: Jul. 14, 2023

(65) Prior Publication Data

US 2024/0053092 A1 Feb. 15, 2024

Related U.S. Application Data

(63) Continuation of application No. PCT/KR2023/009104, filed on Jun. 29, 2023.

(30) Foreign Application Priority Data

Aug. 11, 2022 (KR) ..... 10-2022-0100955

(51) Int. Cl.
*F25D 23/12* (2006.01)
*F25C 5/18* (2018.01)
*F25C 5/20* (2018.01)

(52) U.S. Cl.
CPC ..... *F25D 23/12* (2013.01); *F25C 5/18* (2013.01); *F25C 5/22* (2018.01)

(58) Field of Classification Search
CPC .. F25C 5/18; F25C 5/182; F25C 5/185; F25C 2400/10; F25C 1/24; F25D 23/12; F25D 25/02
See application file for complete search history.

(56) References Cited

U.S. PATENT DOCUMENTS 3,280,584 A * 10/1966 Grimm ..... F25C 1/24 62/344
6,708,509 B1 * 3/2004 Senner ..... F25C 5/22 62/344

(Continued)

FOREIGN PATENT DOCUMENTS

CN 2660436 Y 12/2004
CN 111174489 A 5/2020

(Continued)

OTHER PUBLICATIONS

Translation CN111174489A (Year: 2020).*

(Continued)

*Primary Examiner* — Andrew Roersma
(74) *Attorney, Agent, or Firm* — Sughrue Mion, PLLC

(57) ABSTRACT

A refrigerator includes: an outer case forming an exterior of the refrigerator; an inner case provided in the outer case and including a first inner wall and a second inner wall opposite to the first inner wall; and an ice maker mounted on the inner case and configured to produce ice, the ice maker including an ice making case and an ice making cover covering an upper side of the ice making case, wherein the ice making case is supported by the first inner wall and the second inner wall, and the ice making cover is detachably coupled to the ice making case and configured to support an item on an upper side of the ice making cover.

18 Claims, 24 Drawing Sheets

(56) References Cited

U.S. PATENT DOCUMENTS

| | | | | |
|---|---|---|---|---|
| 7,624,593 | B2 | 12/2009 | Lee et al. | |
| 8,733,122 | B2 | 5/2014 | Lim et al. | |
| 9,625,200 | B2 | 4/2017 | Gu et al. | |
| 9,631,854 | B2 | 4/2017 | Seo et al. | |
| 9,677,806 | B2 | 6/2017 | Bischofberger et al. | |
| 9,897,370 | B2 | 2/2018 | Gillette et al. | |
| 12,163,725 | B2 * | 12/2024 | Ma | F25D 23/061 |
| 2007/0227176 | A1 * | 10/2007 | Anell | F25C 5/185 62/340 |
| 2013/0263620 | A1 * | 10/2013 | An | F25D 23/066 29/890.035 |
| 2014/0283542 | A1 * | 9/2014 | Jang | F25C 1/00 62/340 |
| 2018/0017310 | A1 * | 1/2018 | Jeong | F25D 23/04 |
| 2018/0313601 | A1 * | 11/2018 | Sert | F25D 25/025 |
| 2021/0222930 | A1 * | 7/2021 | Zhao | F25C 5/22 |
| 2021/0404725 | A1 * | 12/2021 | Olvera | F25D 25/021 |
| 2022/0154990 | A1 * | 5/2022 | Yao | F25D 21/14 |

FOREIGN PATENT DOCUMENTS

| | | | | |
|---|---|---|---|---|
| CN | 108955029 | B * | 9/2020 | F25D 23/12 |
| CN | 113074490 | A * | 7/2021 | F25D 25/025 |
| DE | 102014221700 | A1 * | 4/2016 | F25C 1/24 |
| EP | 2 381 195 | B1 | 5/2019 | |
| EP | 3 004 757 | B1 | 7/2020 | |
| JP | 9-159335 | A | 6/1997 | |
| KR | 1998-023799 | A | 7/1998 | |
| KR | 20-1998-0048610 | U | 9/1998 | |
| KR | 10-0524785 | B1 | 10/2005 | |
| KR | 10-0593618 | B1 | 6/2006 | |
| KR | 10-2011-0117596 | A | 10/2011 | |
| KR | 10-2013-0128563 | A | 11/2013 | |
| KR | 20-2014-0002278 | U | 4/2014 | |
| KR | 10-2014-0059938 | A | 5/2014 | |
| KR | 10-2015-0058764 | A | 5/2015 | |
| KR | 10-1761739 | B1 | 7/2017 | |
| KR | 10-2022-0100401 | A | 7/2022 | |
| WO | WO-2014195220 | A1 * | 12/2014 | F25C 5/20 |
| WO | WO-2021218192 | A1 * | 11/2021 | F25C 1/24 |
| WO | WO-2023246543 | A1 * | 12/2023 | F25D 17/06 |

OTHER PUBLICATIONS

Extended European Search Report issued Jun. 27, 2025 by the European Patent Office for EP Patent Application No. 23852740.2.
International Search Report (PCT/ISA/210) issued on Oct. 17, 2023 by the International Searching Authority in International Patent Application No. PCT/KR2023/009104.
Written Opinion (PCT/ISA/237) issued on Oct. 17, 2023 by the International Searching Authority in International Patent Application No. PCT/KR2023/009104.

* cited by examiner

REFRIGERATOR

CROSS-REFERENCE TO RELATED APPLICATION(S)

This application is a continuation application, under 35 U.S.C. § 111(a), of international application No. PCT/KR2023/009104, filed on Jun. 29, 2023, which claims priority to Korean Patent Application No. 10-2022-0100955, filed on Aug. 11, 2022, in the Korean Intellectual Property Office, the disclosure of which is incorporated by reference herein in its entirety

BACKGROUND

1. Field

The disclosure relates to a refrigerator, and more particularly, to a refrigerator including an ice maker.

2. Description of Related Art

A refrigerator is a device that keeps food fresh and includes a main body including a storage compartment, and a cold air supply system configured to supply cold air to the storage compartment. The storage compartment includes a refrigerating compartment maintained at approximately 0 to 5 degrees Celsius to refrigerate food, and a freezing compartment maintained at approximately 0 to −30 degrees Celsius to freeze and store food. In general, the storage compartment is provided to allow a front surface to be opened to input or withdraw food, and the open front surface of the storage compartment is opened and closed by a door.

The refrigerator repeats a refrigeration cycle in which a refrigerant is compressed, condensed, expanded, and evaporated using a compressor, a condenser, an expander, and an evaporator. At this time, a single evaporator arranged in the freezing compartment may cool both the freezing compartment and the refrigerating compartment, or an evaporator may be provided in the freezing compartment and the refrigerating compartment, respectively, so that cooling may be performed independently of each other.

The refrigerator may include with an ice maker configured to produce ice. The ice maker automatically produces ice by including an ice making tray configured to produce ice, an ejector configured to eject ice from the ice making tray, an ice bucket provided to store the ice ejected from the ice making tray, and a controller configured to control the ice making process.

SUMMARY

According to an aspect of the disclosure, a refrigerator includes: an outer case forming an exterior of the refrigerator; an inner case provided in the outer case and including a first inner wall and a second inner wall opposite to the first inner wall; and an ice maker mounted on the inner case and configured to produce ice, the ice maker including an ice making case and an ice making cover covering an upper side of the ice making case, wherein the ice making case is supported by the first inner wall and the second inner wall, and the ice making cover is detachably coupled to the ice making case and configured to support an item on an upper side of the ice making cover.

The ice making cover may include: a shelf member covering the ice making case; and a fixing protrusion protruding from the shelf member toward the ice making case, the ice making case may include an insertion hole into which the fixing protrusion is inserted.

The ice making case may further include a locking protrusion at an edge of the insertion hole, and the fixing protrusion may include a hooking member configured to be locked to the locking protrusion.

The fixing protrusion may further include an insertion member protruding downward from the shelf member and configured to be inserted into the insertion hole, and the hooking member protrudes from the insertion member.

The locking protrusion may be provided on a front of the edge of the insertion hole, the hooking member protrudes a forward direction from the insertion member, and the forward direction is from an inside of the refrigerator and towards a door of the refrigerator.

The locking protrusion is provided on a rear of the edge of the insertion hole, the hooking member protrudes in a backward direction from the insertion member, and the backward direction is from an inside of the refrigerator and away from a door of the refrigerator.

The shelf member may be spaced apart from the ice making case.

The shelf member may include: a support surface configured to support the item placed on the upper side; and an edge surface on an edge of the support surface, and the support surface is recessed from the edge surface.

The shelf member may further include a stepped member between the support surface and the edge surface.

The shelf member may further include a guide rib protruding upward from the edge surface and disposed in front of the support surface.

The inner case may include a rear wall, the ice making cover may further include a rear inclined member extending from the shelf member toward the rear wall and inclined upward, the rear inclined member covers a water supplier of the refrigerator, and the water supplier is configured to supply water into the ice making case.

The ice making cover may further include a front inclined member extending from the shelf member to a front side and inclined downward.

The inner case may further include a rear wall, the fixing protrusion is a first fixing protrusion, the ice making cover may further include a second fixing protrusion parallel to the first fixing protrusion and spaced apart in a second direction perpendicular to a first direction in which the ice making cover is inserted toward the rear wall, the insertion hole is a first insertion hole, and the ice making case may further include a second insertion hole disposed parallel to the first insertion hole, spaced apart in the second direction, and configured to receive the second fixing protrusion inserted thereinto.

The ice making case may further include a first locking protrusion provided on an edge adjacent to the first inner wall, the first fixing protrusion may include a first insertion member and a first hooking member, the first insertion member extends downward from the shelf member and is configured to be inserted into the first insertion hole, and the first hooking member is configured to be locked to the first locking protrusion and protrudes from the first insertion member toward the first inner wall.

The ice making case may further include a first locking protrusion on an edge adjacent to the second inner wall, the first fixing protrusion may include a first insertion member and a first hooking member, the first insertion member extends downward from the shelf member and is configured to be inserted into the first insertion hole, and the first hooking member is configured to be locked to the first locking protrusion and protrudes from the first insertion member toward the first inner wall.

According to an aspect of the disclosure, a refrigerator includes: an outer case forming an exterior of the refrigerator; an inner case including a first side wall and a second side wall facing to the first side wall; and an ice maker mounted on the inner case, configured to produce ice, and including an ice making case and an ice making cover covering an upper side of the ice making case, wherein the ice making case may include an insertion hole configured to couple to the ice making cover, and the ice making cover is configured to support an item in the inner case and may include a fixing protrusion inserted into the insertion hole.

The ice making case may include a locking protrusion at a front of an edge of the insertion hole, the fixing protrusion may include an insertion member, inserted into the insertion hole, and a hooking member protruding in a forward direction from the insertion member and locked to the locking protrusion, and the forward direction is a direction from an inside of the refrigerator and towards a door of the refrigerator.

The ice making case may include a locking protrusion at a rear of an edge of the insertion hole, the fixing protrusion may include an insertion member, inserted into the insertion hole, and a hooking member protruding a backward direction from the insertion member and locked to the locking protrusion, and the backward direction is a direction from an inside of the refrigerator and away from a door of the refrigerator.

The ice making cover may further include a shelf member having a rectangular shape and configured to support an item placed on an upper side, and the shelf member may include a guide rib protruded from the upper side.

According to an aspect of the disclosure, a refrigerator includes: an outer case at an exterior of the refrigerator; an inner case and including a first side wall and a second side wall facing to the first side wall; an ice making case mounted on the inner case, configured to produce ice, and supported by the first side wall and the second side wall, the ice making case including a fixing protrusion protruding upward; and an ice making cover configured to support an item placed on an upper side of the ice making cover, and covering an upper side of the ice making case, the ice making cover including an insertion hole into which the fixing protrusion is inserted.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
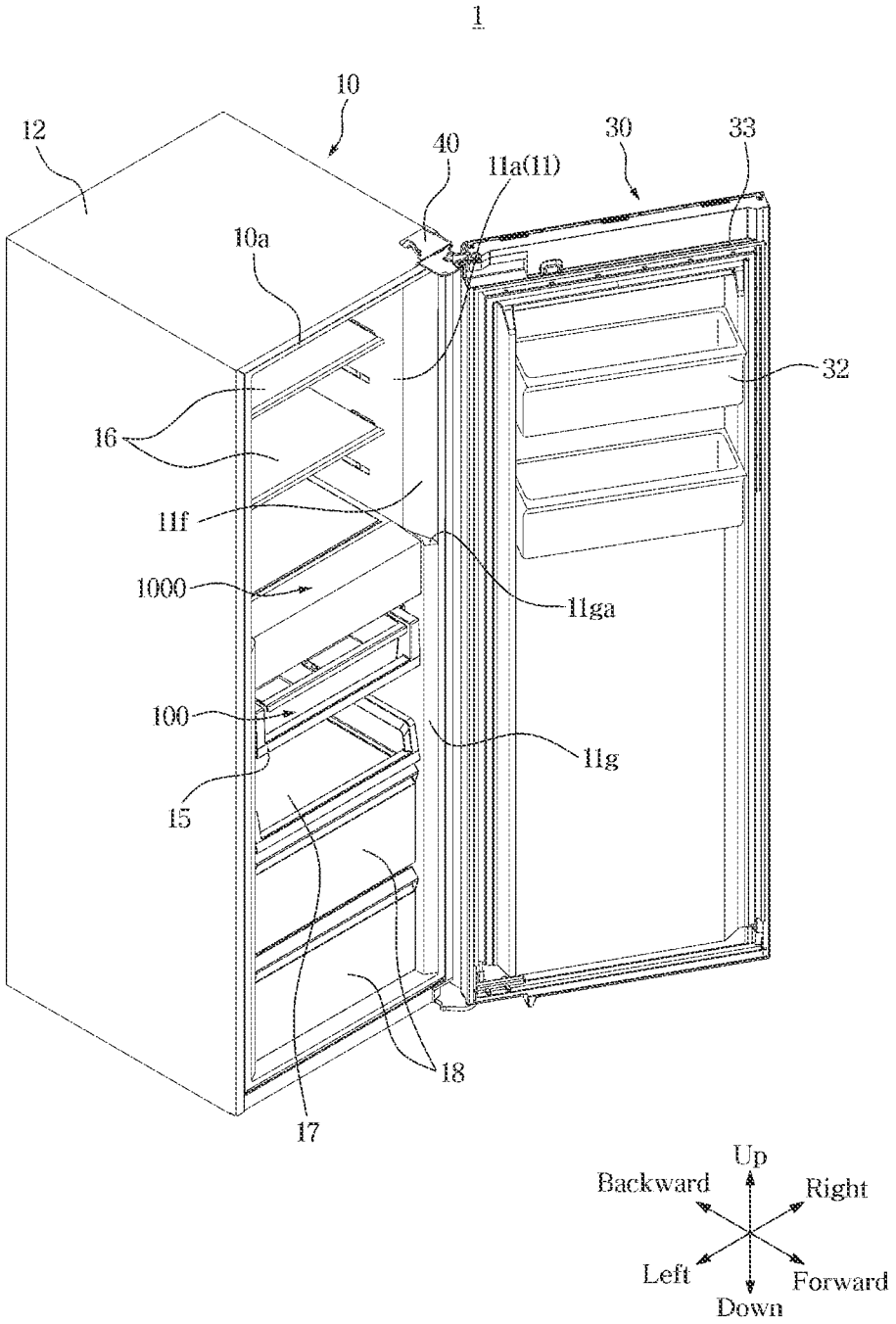
FIG. 1 is a perspective view of a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms “a,” “an” and “the” are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "up and down direction", "lower side", "front and rear direction", and the like may be defined by the drawings, but the shape and the location of the component is not limited by the term.

Reference will now be made in detail to embodiments of the disclosure, examples of which are illustrated in the accompanying drawings.

Therefore, it is an aspect of the disclosure to provide a refrigerator including an improved structure capable of allowing an ice making cover of an ice maker to be detachable from an ice making case.

It is another aspect of the disclosure to provide a refrigerator including an improved structure capable of supporting an item on an upper side of an ice making case.

Additional aspects of the disclosure will be set forth in part in the description which follows and, in part, will be obvious from the description, or may be learned by practice of the disclosure.

Figure 2:
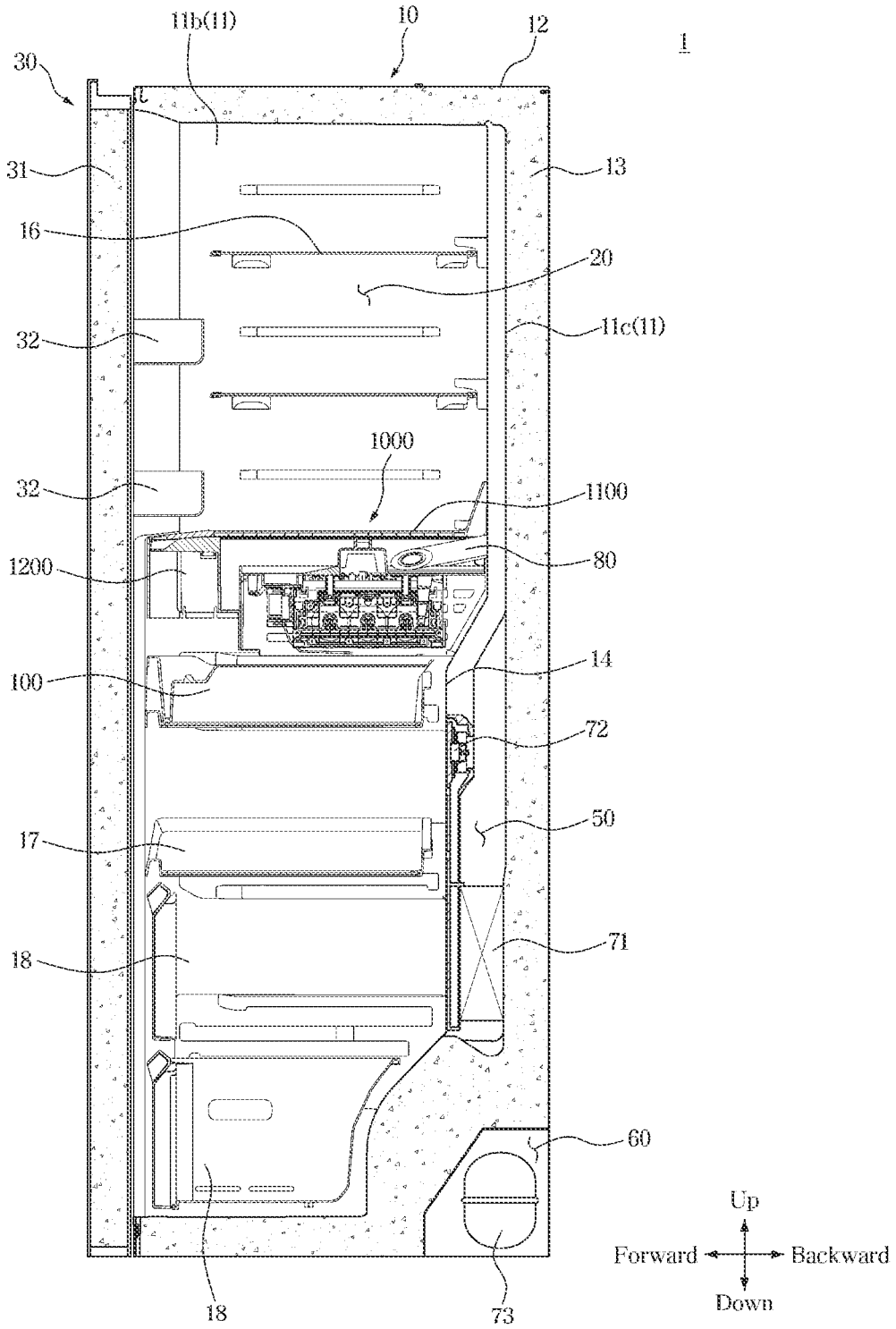
FIG. 2 is a schematic side cross-sectional view of the refrigerator according to an embodiment of the disclosure.

FIG. 1 is a perspective view of a refrigerator according to an embodiment of the disclosure. FIG. 2 is a schematic side cross-sectional view of the refrigerator according to an embodiment of the disclosure.

Referring to FIG. 1 and FIG. 2, a refrigerator 1 may include a main body 10, a storage compartment 20 formed inside the main body 10, a door 30 configured to open and close the storage compartment 20, and a cooling system configured to supply cold air to the storage compartment 20.

The main body 10 may have an open front surface to allow a user to input food to and withdraw food from the storage compartment 20. That is, the main body 10 may include an opening 10*a* formed on a front surface of the main body 10. The opening 10*a* of the main body 10 may be opened and closed by the door 30. The opening 10*a* of the main body 10 may be referred to as an opening 10*a* of an outer case 12, and an opening 10*a* of an inner case 11, which will be described later.

The main body 10 may include the inner case 11 forming the storage compartment 20, the outer case 12 forming the exterior of the refrigerator 1, and a main body insulator 13 provided between the inner case 11 and the outer case 12.

The outer case 12 may be formed to have an approximate shape of a box with a front side open. The outer case 12 may form upper and lower surfaces, left and right surfaces, and a rear surface of the refrigerator 1.

The outer case 12 may be provided to include a metal material. For example, the outer case 12 may be manufactured by processing a steel plate material.

A front surface of the inner case 11 may be opened. The storage compartment 20 may be provided inside the inner case 11, and the inner case 11 may be provided inside the outer case 12. An inner wall of the inner case 11 may form an inner wall of the storage compartment 20.

The inner wall of the inner case 11 may include a first inner wall 11*a*, a second inner wall 11*b* opposite to the first inner wall 11*a*, and a rear wall 11*c* provided between the first inner wall 11*a* and the second inner wall 11*b*, an upper wall, and a lower wall. For example, the first inner wall 11*a* may refer to an inner wall of the inner case 11 provided on the right side when viewed from the front of the refrigerator 1. The second inner wall 11*b* may refer to an inner wall of the inner case 11 that faces the first inner wall 11*a* and is provided on the left side when viewed from the front of the refrigerator 1.

However, the positions of the first inner wall 11*a* and the second inner wall 11*b* are not limited thereto. Alternatively, the inner wall of the inner case 11 provided on the left when viewed from the front of the refrigerator 1 may be referred to as the first inner wall 11*a*, and the inner wall of the inner case 11 provided on the right when viewed from the front of the refrigerator 1 may be referred to as the second inner wall 11*b*.

The inner case 11 may be provided to include a plastic material. For example, the inner case 11 may be manufactured by a vacuum forming process. For example, the inner case 11 may be manufactured by an injection molding process.

The main body insulator 13 may be provided to insulate the outer case 12 and the inner case 11 from each other. As the main body insulator 13 is foamed between the inner case 11 and the outer case 12, the inner case 11 and the outer case 12 may be coupled to each other. The main body insulator 13 may prevent heat exchange between the inside of the storage compartment 20 and the outside of the main body 10, thereby improving the cooling efficiency of the storage compartment 20.

Urethane foam insulation, expanded polystyrene (EPS) insulation, or vacuum insulation panel may be used as the main body insulator 13. However, embodiments of the disclosure are not limited thereto, and the main body insulator 13 may be composed of various other materials.

The storage compartment 20 may be formed inside the main body 10. For example, the storage compartment 20 may include a freezing compartment maintained at approximately 0 to −30 degrees Celsius to freeze and store food.

A shelf 16, on which food may be placed, a movable shelf 17, provided to allow food to be placed thereon and provided to be inserted into or withdrawn from the inner case 11, and a drawer 18 provided to store food and provided to be inserted into or withdrawn from the inner case 11 may be arranged in the storage compartment 20.

The inner case 11 may include an inclined wall 11*f*. The inclined wall 11*f* may be disposed in a front portion of the main body 10 to be adjacent to the door 30. The inclined wall 11*f* may protrude toward the inside of the storage compartment 20 with respect to the left and right direction as the inclined wall 11*f* is inclined from one side adjacent to the door 30 to the other side toward the rear wall 11*c*. The other side of the inclined wall 11*f* may be a portion in contact with the first inner wall 11*a* or the second inner wall 11*b*. The inclined wall 11*f* may be disposed along at least a portion of the opening 10*a*.

An inclined protruding wall 11*g* may be disposed below the inclined wall 11*f*. The inclined protruding wall 11*g* may be formed to protrude more toward the inside of the storage compartment 20 with respect to the left and right direction than the inclined wall 11*f*. In addition, the inclined protruding wall 11*g* may be formed to protrude more toward the front than the inclined wall 11*f*. The inclined protruding wall 11*g* may include a protruding upper surface 11*ga*. The protruding upper surface 11*ga* may be disposed adjacent to a front inclined member 1130. The inclined protruding wall 11*g* may be disposed along at least a part of the opening 10*a*.

When a user views the inside of the storage compartment 20 through the opening 10*a* of the main body 10, the inclined wall 11*f* and the inclined protruding wall 11*g* may make a volume of the storage compartment 20 look wider, which may make the user feel an improved aesthetic sense.

An ice making cover 1100 of an ice maker 1000 may be provided with the front inclined member 1130 (refer to FIG. 12) formed to correspond to the inclined shape of the inclined protruding wall 11*g*. Because the inclined shape of the front inclined member 1130 is inclined upward to the rear side, it is possible to give a harmonious aesthetic feeling with the inclined protruding wall 11*g*. The ice making cover 1100 is described below.

The refrigerator 1 may include the cooling system configured to generate cold air using a cooling cycle and configured to supply the generated cold air to the storage compartment 20.

The cooling system may generate cold air by using evaporation latent heat of the refrigerant in the cooling cycle. The cooling system may include a compressor 73, a condenser, an expansion valve, an evaporator 71, and a blowing fan 72.

The main body 10 may be provided with a cooling chamber 50 and a machine room 60 for disposing the cooling system. For example, components such as the evaporator 71 configured to generate cold air and the blowing fan 72 configured to move the cold air generated by the evaporator 71 may be arranged in the cooling chamber 50. Components such as the compressor 73 and the condenser may be arranged in the machine room 50.

The cooling chamber 50 may be disposed behind the storage compartment 20. The machine room 60 may be disposed behind the storage compartment 20.

Components of the refrigerator 1 forming the cooling system may have a relatively heavy weight. Therefore, the cooling chamber 50 and the machine room 60 may be provided in a lower portion of the main body 10. However, embodiments of the disclosure are not limited thereto, and the cooling chamber 50 and the machine room 60 may be arranged in various ways, and components forming the cooling system may be arranged in various ways to correspond to the positions of the cooling chamber 50 and the machine room 60.

Because cold air is generated in the cooling chamber 50 by the evaporator 71, it is possible to maintain the cooling chamber 50 at a relatively low temperature state. However, because heat is generated in the machine room 60 by the compressor 73 and the condenser, it is possible to maintain the machine room 60 at a relatively high temperature state. Therefore, the cooling chamber 50 and the machine room 60 may be formed in a space separated from each other and may be insulated from each other. For example, the main body insulator 13 may be foamed between the cooling chamber 50 and the machine room 60.

As shown in FIG. 2, the evaporator 71 arranged in the cooling chamber 50 may generate cold air by evaporating the refrigerant, and the cold air generated by the evaporator 71 may be moved by the blowing fan 72. The cold air moved by the blowing fan 72 may flow from the cooling chamber 50 to the storage compartment 20. The cooling chamber 50 may be provided to communicate with the storage compartment 20.

For example, the cold air generated by the evaporator 71 may flow upward through the cooling chamber 50 by the blowing fan 72. The cold air moved by the blowing fan 72 may flow toward an upper side of the main body 10 along a cold air supply duct 14. The cold air may be discharged from the cold air supply duct 14 toward the front side and may eventually be introduced into the storage compartment 20. Alternatively, the cold air generated by the evaporator 71 may flow to a lower side of the main body 10 by the blowing fan 72 and may be introduced into the storage compartment 20.

In other words, as shown in FIG. 2, the refrigerator 1 according to an embodiment of the disclosure may be an indirect cooling refrigerator. Hereinafter for convenience of description, the refrigerator 1 according to an embodiment of the disclosure will be described on the premise that it is an indirect cooling refrigerator, but the disclosure is not limited thereto and may be applied to a direct cooling refrigerator.

The evaporator 71 and the blowing fan 72 disposed in the cooling chamber 50 may be referred to as a cold air supply device in that the evaporator 71 and the blowing fan 72 generate cold air and supply the cold air to the storage compartment 20.

The main body 10 may include the cold air supply duct 14. The cold air supply duct 14 may form a cold air flow path through which cold air generated by the cold air supply device flows from the cooling chamber 50 to the storage compartment 20. The storage compartment 20 may be provided to communicate with the cold air supply duct 14.

The cold air supply duct 14 may be formed inside the inner case 11. The cold air supply duct 14 may be formed at the rear of the inner case 11. Particularly, the cold air supply duct 14 may be provided at the rear of the storage compartment 20.

The door 30 may be configured to open and close the storage compartment 20. The door 30 may be rotatably coupled to the main body 10. Particularly, the door 30 may be rotatably coupled to the main body 10 by a hinge 40 respectively connected to the door 30 and the main body 10. The door 30 may be rotatably coupled to the outer case 12.

An outer surface of the door 30 may form a part of the exterior of the refrigerator 1. When the door 30 is closed, the outer surface of the door 30 may form a front surface of the door 30.

An inner surface of the door 30 may be formed on a side opposite to the outer surface of the door 30. When the door 30 is closed, the inner surface of the door 30 may form a rear surface of the door 30. When the door 30 is closed, the inner surface of the door 30 may be provided to face the inside of the main body 10. When the door 30 is closed, the inner surface of the door 30 may be provided to cover the front of the storage compartment 20.

A foaming space may be formed between the outer surface of the door 30 and the inner surface of the door 30, and a door insulator 31 may be foamed in the foaming space. The door insulator 31 may prevent heat exchange between the outer surface and the inner surface of the door 30. The door insulator 31 may improve insulation performance between the inside of the storage compartment 20 and the outside of the door 20.

Urethane foam insulation, expanded polystyrene (EPS) insulation, or vacuum insulation panel may be used as the door insulator 31. However, embodiments of the disclosure are not limited thereto, and the door insulator 31 may be composed of various materials.

For example, the door insulator 31 may be formed of the same material as the main body insulator 13. Unlike this, the door insulator 31 may be formed of a different material from the main body insulator 13.

A door gasket 33 may be arranged on the inner surface of the door 30 to seal a gap between the door 30 and the main body 10 so as to prevent leakage of cold air from the storage compartment 20. The door gasket 33 may be provided along a circumference of the inner surface of the door 30. The door gasket 33 may be disposed parallel to the opening 10*a* of the main body 10 when the door 30 is closed. The door gasket 33 may include an elastic material such as rubber.

A door shelf 32 provided to store food may be arranged on the inner surface of the door 30.

The refrigerator 1 may include the ice maker 1000 configured to produce ice using cold air in the storage compartment 20. The ice maker 1000 may include ice making unit 1300 and ice making unit 1400 (refer to FIG. 5 and the like) configured to produce ice and an ice making case 1200 (refer to FIG. 3 and the like) configured to support the ice making unit 1300 and ice making unit 1400.

The ice maker 1000 may be arranged in the storage compartment 20. The ice maker 1000 may be mounted on the inner case 11. Particularly, the inner case 11 may include holder 11*aa* and holder 11*bb* provided on the inner wall 11*a* and inner wall 11*b* of the inner case 11. The ice maker 1000 may be supported by the holder 11*aa* and the holder 11*bb* (refer to FIG. 5 and the like). For example, the holder 11*aa* and the holder 11*bb* may be formed to protrude from the inner wall 11*a* and inner wall 11*b* of the inner case 11. For example, the holder 11*aa* and holder 11*bb* may be formed to have a shape concavely recessed on the inner wall 11*a* and inner wall 11*b* of the inner case 11.

The refrigerator 1 may further include a water supplier 80 configured to receive water from an external water supply source. The water supplier 80 may be configured to supply water supplied from an external water supply source to the ice maker 1000. The ice maker 1000 may produce ice using water supplied from the water supplier 80.

The water supplier 80 may be formed to have a pipe shape in which a water supply flow path, through which water flows, is formed.

A number of water suppliers, including the water supplier 80, may be provided in accordance with the number of ice making unit 1300 and ice making unit 1400. For example, the ice making unit 1300 and ice making unit 1400 may include a first ice making unit, as the ice making unit 1300, and a second ice making unit, as the ice making unit 1400, (refer to FIG. 5 and the like). The water supplier 80 may be provided in plurality so as to supply water to each of the ice making unit 1300 and the ice making unit 1400.

The water supplier 80 may be disposed to penetrate the main body 10. The water supplier 80 may be disposed to pass through the outer case 12 and the inner case 11. Particularly, the water supplier 80 may penetrate the rear surfaces of the outer case 12 and the inner case 11. The rear surfaces of the outer case 12 and the inner case 11 may be penetrated by the water supplier 80 with respect to the front and rear direction. The rear surface of the inner case 11 may mean the rear wall 11*c* of the inner case 11.

The refrigerator 1 may include an ice bucket 100 provided to accommodate ice produced by the ice maker 1000. The ice bucket 100 may be arranged in the storage compartment 20.

The ice bucket 100 may be mounted on the inner case 11. The ice bucket 100 may be supported by the first inner wall 11*a* and the second inner wall 11*b* of the inner case 11.

The ice bucket 100 may be disposed below the ice maker 1000. The ice bucket 100 may be provided to accommodate ice that is discharged from the ice making unit 1300 and the ice making unit 1400 and moved downward.

A bucket shelf 15 provided to support the ice bucket 100 may be arranged in the storage compartment 20. The ice bucket 100 may be seated on the bucket shelf 15. The bucket shelf 15 may be supported by the first inner wall 11*a* and the second inner wall 11*b*.

The ice maker 1000 and the ice bucket 100 are further described below.

The configuration of the refrigerator 1 described above with reference to FIG. 1 and FIG. 2 is only an example for describing the refrigerator according to the disclosure, and the disclosure is not limited thereto. The refrigerator according to the disclosure may be provided to include various configurations for performing a function of supplying cold air to the storage compartment for storing food.

In the above-mentioned description, for convenience of description, the refrigerator 1 including the main body 10 including a single storage compartment 20 formed therein and a single door 30 configured to open and close the storage compartment 20 has been described as an example of the disclosure. However, the disclosure is not limited thereto and the configuration of the disclosure may be applied to various types of refrigerators. The refrigerator according to an embodiment of the disclosure may be a Side by Side (SBS) type in which a refrigerating compartment and a freezing compartment are disposed on the left and right sides (refer to FIG. 24). Alternatively, the refrigerator according to an embodiment of the disclosure may be a bottom mounted freezer (BMF) type in which a refrigerating compartment is formed on the upper side and a freezing compartment is formed on the lower side. The refrigerator according to an embodiment of the disclosure may be a top mounted freezer (TMF) type in which a freezing compartment is formed on the upper side and a refrigerating compartment is formed on the lower side.

Figure 3:
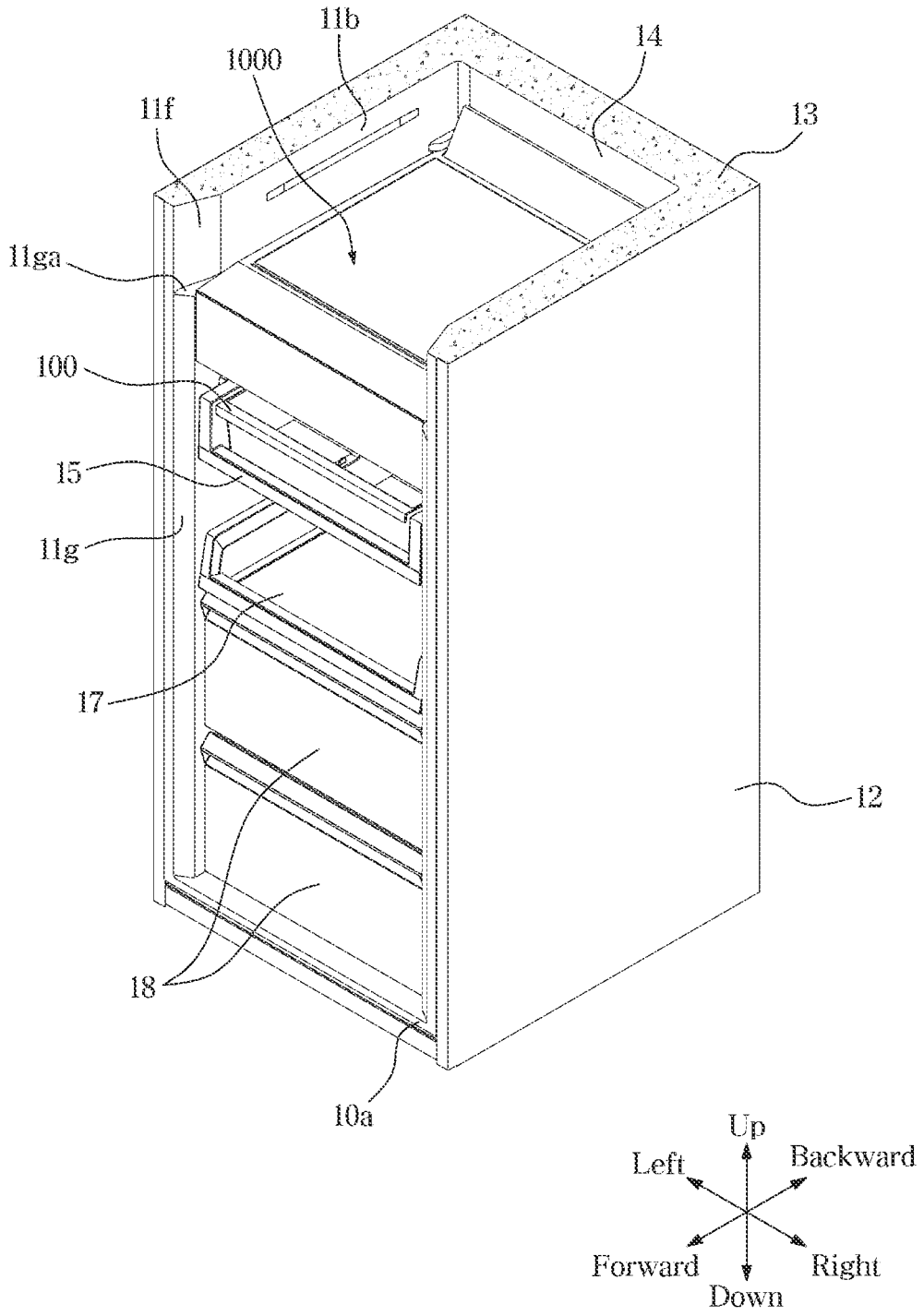
FIG. 3 is a cross-sectional perspective view of the refrigerator according to an embodiment of the disclosure.
Figure 4:
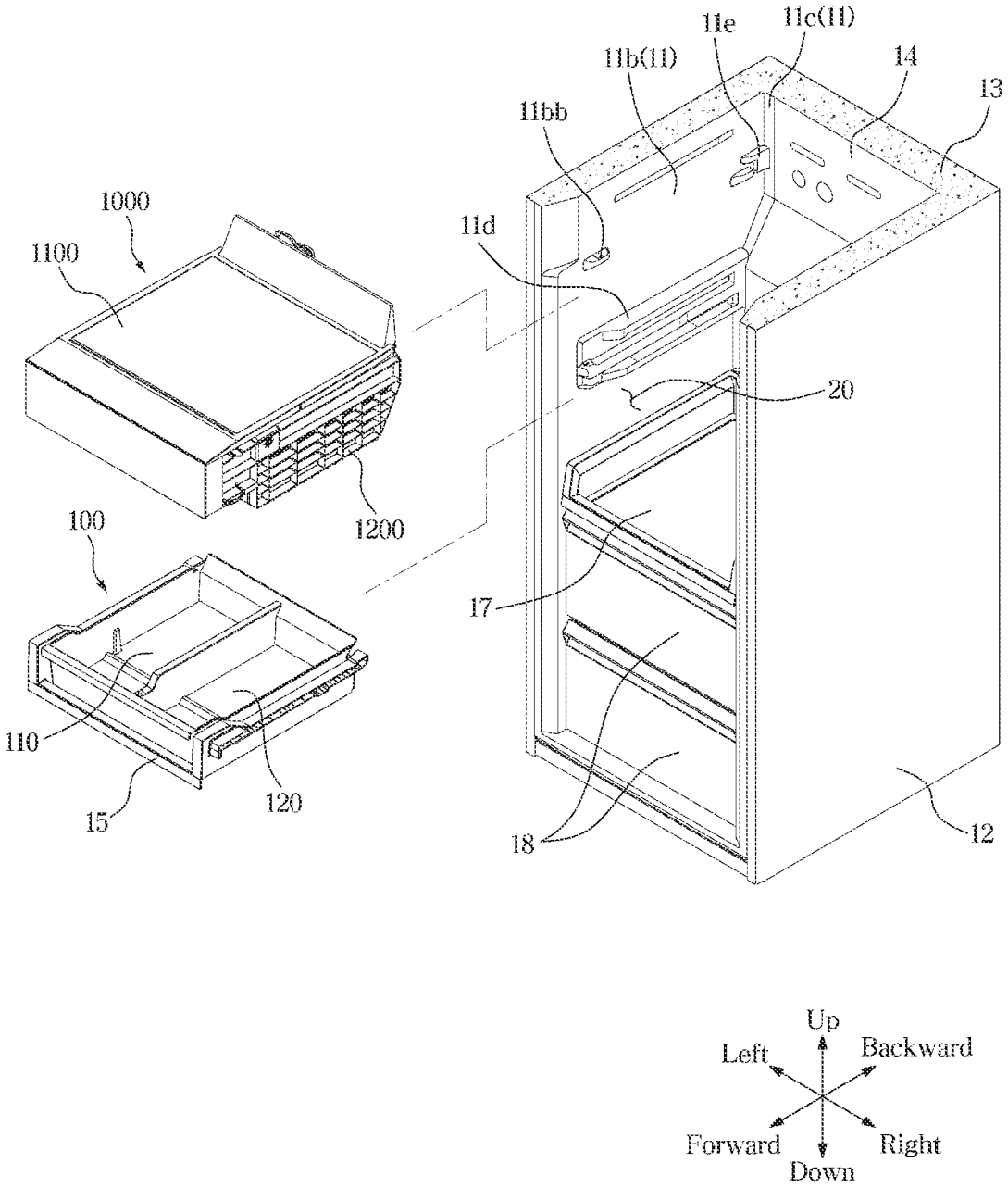
FIG. 4 is a view illustrating a state in which some components of the refrigerator of FIG. 3 are disassembled.
Figure 5:
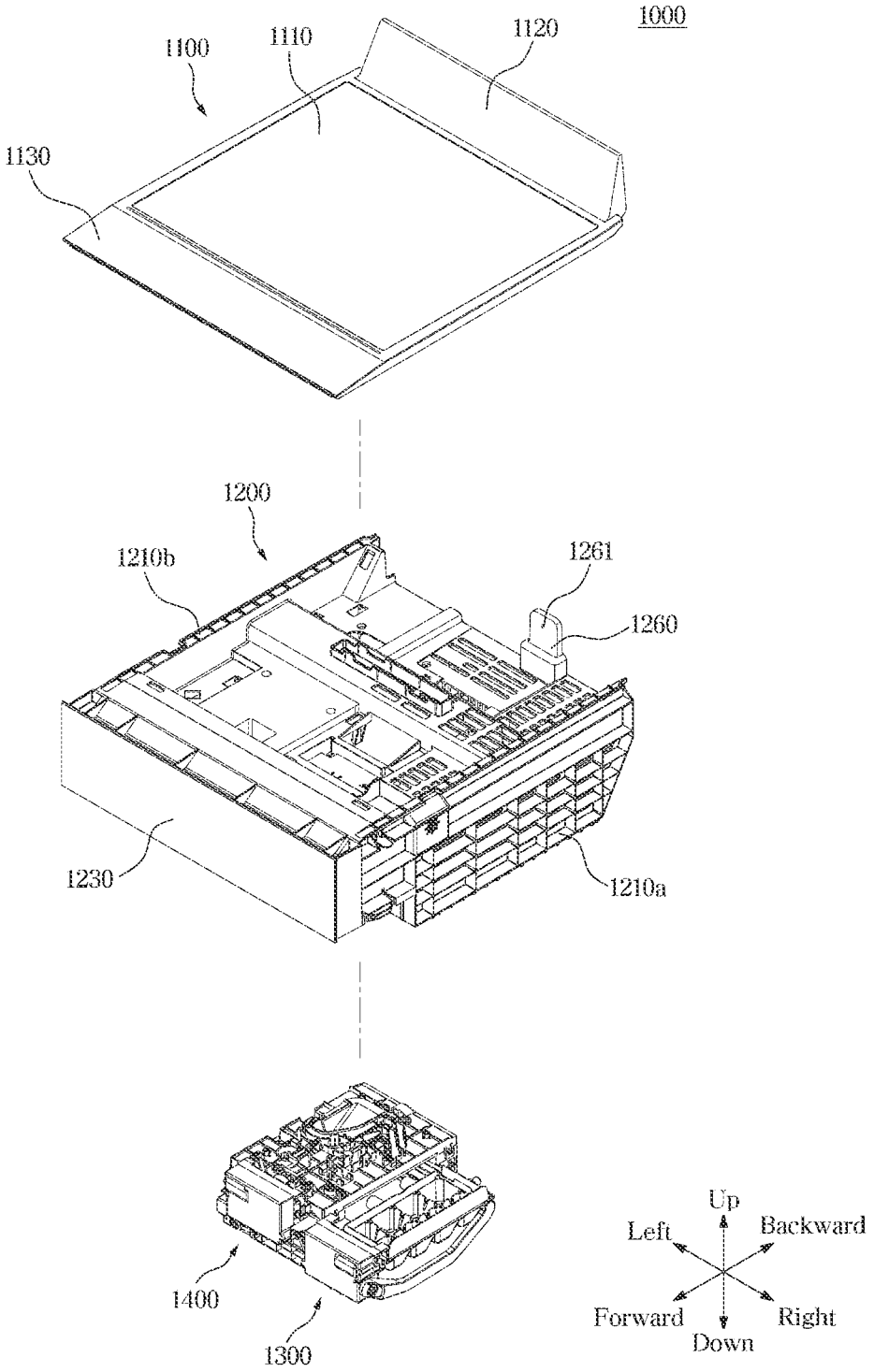
FIG. 5 is an exploded view of an ice maker of the refrigerator according to an embodiment of the disclosure.
Figure 6:
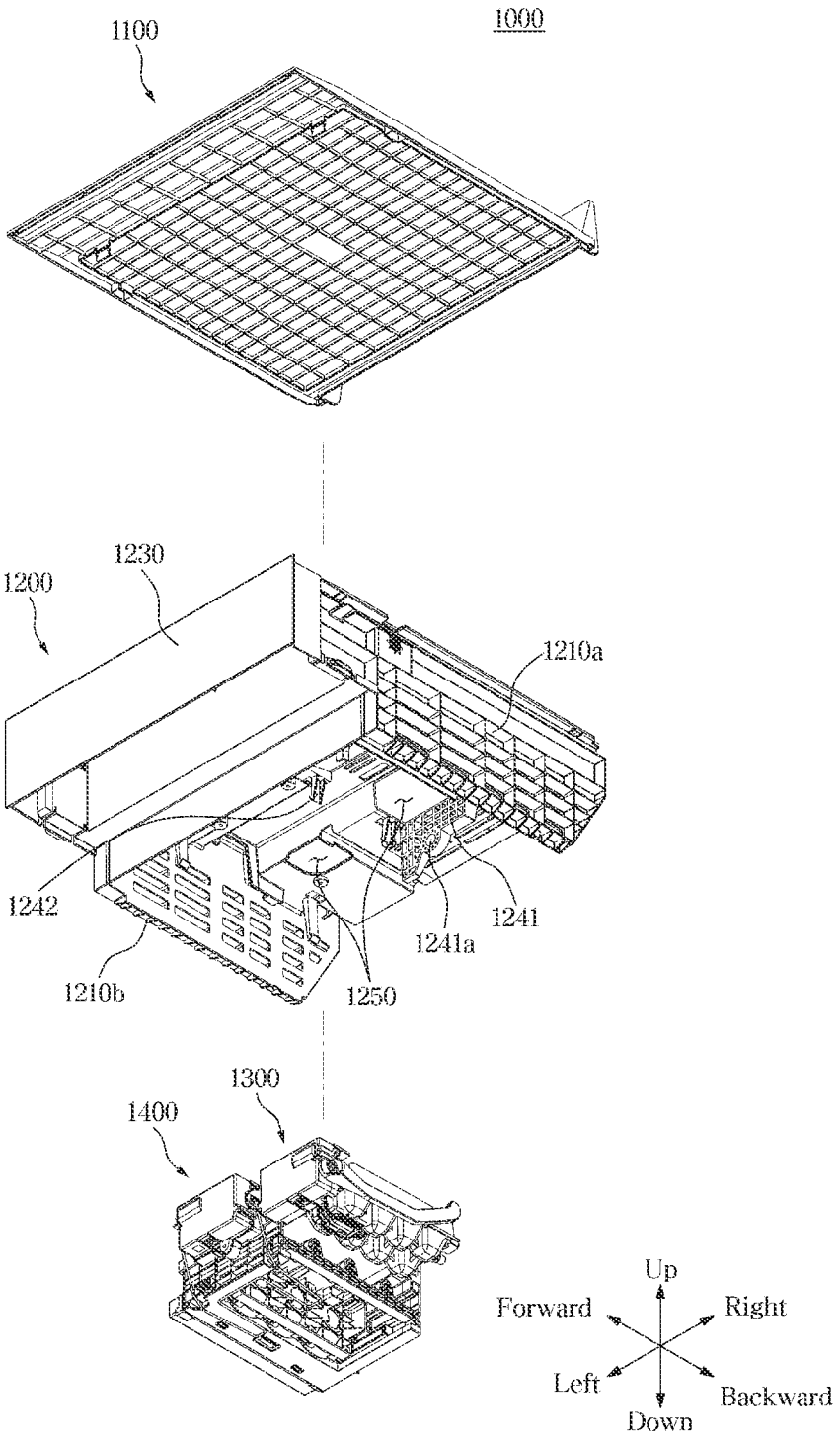
FIG. 6 is a view illustrating the ice maker of FIG. 5 when viewed from another angle.

FIG. 3 is a cross-sectional perspective view of the refrigerator according to an embodiment of the disclosure. FIG. 4 is a view illustrating a state in which some components of the refrigerator of FIG. 3 are disassembled. FIG. 5 is an exploded view of an ice maker of the refrigerator according to an embodiment of the disclosure. FIG. 6 is a view illustrating the ice maker of FIG. 5 when viewed from another angle.

Referring to FIG. 3, FIG. 4, FIG. 5, and FIG. 6, the ice maker 1000 of the refrigerator 1 may be provided in the storage compartment 20. The ice maker 1000 may be mounted on the inner case 11.

The ice maker 1000 may be supported by the first inner wall 11*a* and the second inner wall 11*b* of the inner case 11. The ice maker 1000 may be disposed between the first inner wall 11*a* and the second inner wall 11*b*.

As illustrated in FIG. 3 and FIG. 4, the first inner wall 11*a* may be the inner wall of the inner case 11 provided on the right side when viewed from the front of the refrigerator 1, and the second inner wall 11*b* may be the inner wall of the inner case 11 arranged to face the first inner wall 11*a* and provided on the left side when viewed from the front of the refrigerator 1. That is, the ice maker 1000 may be mounted on the inner case 11 so as to be supported by the left inner wall and the right inner wall of the inner case 11, respectively. The first inner wall 11*a* and the second inner wall 11*b* on which the ice maker 1000 is supported may face each other with respect to the left and right direction of the refrigerator 1.

However, embodiments of the disclosure are not limited thereto, and when the refrigerator according to an embodiment of the disclosure is a Side by Side (SBS) type refrigerator in which a refrigerating compartment and a freezing compartment are disposed on the left and right, a vertical partition provided to partition the refrigerating compartment and the freezing compartment may be arranged between the refrigerating compartment and the freezing compartment. In this case, the first inner wall may be one of a left inner wall or a right inner wall of the inner case, and the second inner wall may be a side wall of the vertical partition facing the first inner wall.

Hereinafter for convenience of description, the first inner wall 11*a* and the second inner wall 11*b* will be defined and described based on those shown in FIG. 3 and FIG. 4 and the like.

The ice maker 1000 may include the ice making unit 1300 and the ice making unit 1400 configured to produce ice and the ice making case 1200 provided to support the ice making unit 1300 and the ice making unit 1400.

The ice making case 1200 may be mounted on the inner case 11. The ice making case 1200 may be supported by the inner case 11. The ice making case 1200 may be supported by the inner wall 11*a* and the inner wall 11*b* of the inner case 11.

Particularly, the ice making case 1200 may include ice making case wall 1210*a* and ice making case wall 1210*b* supported by the inner wall 11*a* and the inner wall 11*b* of the inner case 11. The ice making case wall 1210*a* and ice making case wall 1210*b* may be outer walls of the ice making case 1200 facing the inner wall 11*a* and the inner wall 11*b* of the inner case 11.

The ice making case wall 1210*a* and the ice making case wall 1210*b* may include a first ice making case wall, as the ice making case wall 1210*a* supported by the first inner wall 11*a*, and a second ice making case wall, as the ice making case wall 1210*b* supported by the second inner wall 11*b*. The ice making case wall 1210*a* may be an outer wall of the ice making case 1200 facing the first inner wall 11*a*. As shown in FIG. 3, FIG. 4, FIG. 5, and FIG. 6, the ice making case wall 1210*a* may be a right outer wall of the ice making case 1200 provided on the right side when viewed from the front. The ice making case wall 1210*b* may be an outer wall of the ice making case 1200 facing the second inner wall 11*b*. As shown in FIG. 3, FIG. 4, FIG. 5, and FIG. 6, the ice making case wall 1210*b* may be opposite to the ice making case wall 1210*a*, and may be a left outer wall of the ice making case 1200 arranged on the left side when viewed from the front.

The ice making case wall 1210*a* may be disposed substantially parallel to the first inner wall 11*a*. The ice making case wall 1210*b* may be disposed substantially parallel to the second inner wall 11*b*.

The ice making case wall 1210*a* and the ice making case wall 1210*b* may be formed parallel to each other. The ice making case wall 1210*a* and the ice making case wall 1210*b* may be formed to have shapes substantially corresponding to each other.

The inner case 11 may include the holder 11*aa* and the holder 11*bb* formed on the inner wall 11*a* and the inner wall 11*b* of the inner case 11. The ice making case 1200 may be supported by the holder 11*aa* and the holder 11*bb*.

The holder 11*aa* and the holder 11*bb* may be formed to have various shapes capable of supporting the ice making case wall 1210*a* and the ice making case wall 1210*b*.

For example, the holder 11*aa* and the holder 11*bb* may be formed to have a shape protruding from the inner wall 11*a* and the inner wall 11*b* of the inner case 11. The holder 11*aa* and holder 11*bb* may protrude to support the ice making case wall 1210*a* and the ice making case wall 1210*b*. The holder flea and holder 11*bb* may protrude toward the inside of the storage compartment 20. In this case, as shown in FIG. 3*m* FIG. 4, FIG. 5, and FIG. 6, the holder 11*aa* and the holder 11*bb* may be inserted into concave members formed in the ice making case wall 1210*a* and the ice making case wall 1210*b* to support the ice making case wall 1210*a* and the ice making case wall 1210*b*. Alternatively, the holder 11*aa* and the holder 11*bb* may support the lower sides of the ice making case wall 1210*a* and the ice making case wall 1210*b*.

For example, the holder 11*aa* and the holder 11*bb* may be formed to have a shape concavely recessed on the inner wall 11*a* and the inner wall 11*b* of the inner case 11. The ice making case wall 1210*a* and the ice making case wall 1210*b* may be provided with protruding members protruding toward the inner wall 11*a* and the inner wall 11*b* of the inner case 11, and the protruding members of the ice making case wall 1210*a* and the ice making case wall 1210*b* may be supported by the holder 11*aa* and the holder 11*bb* as the protruding members are inserted into the holder 11*aa* and the holder 11*bb*.

Hereinafter, an embodiment in which the holder 11*aa* and the holder 11*bb* are formed to protrude to support the ice making case wall 1210*a* and the ice making case wall 1210*b* as shown in FIG. 3, FIG. 4, FIG. 5, and FIG. 6 will be described. However, the disclosure is not limited thereto, and as described above, the holder 11*aa* and the holder 11*bb* supporting the ice making case wall 1210*a* and the ice making case wall 1210*b* may be recessed on the inner wall 11*a* and the inner wall 11*b* of the inner case 11.

The holder 11*aa* and the holder 11*bb* may extend in a direction parallel to the front and rear direction of the inner case 11. The holder 11*aa* and the holder 11*bb* may extend in a direction parallel to the front and rear direction of the inner wall 11*aa* and the inner wall 11*bb* of the inner case 11. Accordingly, the ice making case wall 1210*a* and the ice making case wall 1210*b* may be stably supported in the vertical direction of the inner case 11 by the holder 11*aa* and the holder 11*bb*.

For example, the ice making case 1200 may slide from the front to the rear of the inner case 11 along the holder ilea and the holder 11*bb* extending in a direction parallel to the front and rear direction of the inner case 11 and then the ice making case 1200 may be mounted thereon. In other words, the ice making case 1200 may slide from the front to the rear of the inner case 11 and be mounted on the inner case 11. When the ice making case 1200 is mounted on the inner case 11, the ice making case 1200 may be inserted from the front to the rear of the inner case 11.

When the ice making case 1200 is mounted on the inner case 11, the holder 11*aa* and the holder 11*bb* may guide a mounting position of the ice making case 1200 in the inner case 11 and a mounting direction of the ice making case 1200 to the inner case 11.

However, embodiments of the disclosure are not limited thereto, and a manner in which the ice making case 1200 is mounted on the inner case 11 may be provided in various ways. For example, the ice making case 1200 may be mounted while sliding in the vertical direction with respect to the inner case 11. Even at this time, the holder 11*aa* and the holder 11*bb* may still extend in a direction parallel to the front and rear direction of the inner case 11.

The holder 11*aa* and the holder 11*bb* may be provided to support upper portions of the ice making case wall 1210*a* and the ice making case wall 1210*b*. For example, the ice making case wall 1210*a* and the ice making case wall 1210*b* may be supported by the holder 11*aa* and the holder 11*bb* as the upper portions of the ice making case wall 1210*a* and the ice making case wall 1210*b* are seated on the upper surfaces of the holder 11*aa* and the holder 11*bb*. Accordingly, the ice making case 1200 may be stably supported by the holder 11*aa* and the holder 11*bb*. However, embodiments of the disclosure are not limited thereto, and the ice making case walls 1210*a* and 1210*b* may be supported in various ways by the holder 11*aa* and the holder 11*bb*.

The holder 11*aa* and the holder 11*bb* may be arranged at positions adjacent to the front of the inner case 11. That is, the holder 11*aa* and the holder 11*bb* may be disposed closer to the opening 10*a* of the inner case 11 than the rear wall 11*c* of the inner case 11. Accordingly, the holder 11*aa* and the holder 11*bb* may support at least the front portion of the ice making case 1200. In addition, the holder 11*aa* and the holder 11*bb* are provided at positions adjacent to the front of the inner case 11, and thus when the ice making case 1200 is inserted into the inner case 11 from the front to the rear and mounted, the ice making case 1200 may be more easily guided by the holder 11*aa* and the holder 11*bb*.

However, embodiments of the disclosure are not limited thereto, and the holder 11*aa* and the holder 11*bb* may be provided in various positions. For example, the holder 11*aa* and the holder 11*bb* may be provided at positions adjacent to the rear wall 11*c* of the inner case 11. For example, the holder 11*aa* and the holder 11*bb* may be provided at positions separated from the opening 10*a* and the rear wall 11*c* of the inner case 11 by substantially the same distance.

A rear holder 11*e* provided to support the rear portion of the ice making case 1200 may be further provided in the inner case 11. The ice making case wall 1210*a* and the ice making case wall 1210*b* may be supported not only by the holder 11*aa* and the holder 11*bb* but also by the rear holder 11*e*. For example, the rear holder 11*e* may be provided on the first inner wall 11*a* and the second inner wall 11*b* of the inner case 11. For example, the rear holder 11*e* may be provided on the rear wall 11*c* of the inner case 11. However, embodiments of the disclosure are not limited thereto, and the rear holder 11*e* may not be provided in the inner case 11.

The holder 11*aa* and the holder 11*bb* may include a first holder 11*aa* arranged on the first inner wall 11*a* and provided to support the first ice making case wall 1210*a*, and a second holder 11*aa* arranged on the second inner wall 11*b* and provided to support the second ice making case wall 1210*b*.

The first holder 11*aa* and the second holder 11*bb* may be provided to face each other. The first holder 11*aa* and the second holder 11*bb* may be provided at positions corresponding to each other. The first holder 11*aa* and the second holder 11*bb* may have shapes corresponding to each other.

The first holder 11*aa* may have a shape protruding toward the storage compartment 20. The first holder 11*aa* may protrude from the first inner wall 11*a* toward the first ice making case wall 1210*a*.

The second holder 11*bb* may have a shape protruding toward the storage compartment 20. The second holder 11*bb* may have a shape protruding from the second inner wall 11*b* toward the second ice making case wall 1210*b*.

When the first holder 11*aa* is arranged closer to the opening 10*a* of the inner case 11 than the rear wall 11*c* of the inner case 11, the rear holder 11*e* may be disposed behind the first holder 11*aa*. The first holder 11*aa* and the rear holder 11*e* may support the first ice making case wall 1210*a*.

When the second holder 11*bb* is arranged closer to the opening 10*a* of the inner case 11 than the rear wall 11*c* of the inner case 11, the rear holder 11*e* may be disposed behind the second holder 11*bb*. The second holder 11*bb* and the rear holder 11*e* may support the second ice making case wall 1210*b*.

Rear holders, including the rear holder 11*e*, may be provided in plurality to support the first ice making case wall 1210*a* and the second ice making case wall 1210*b*.

However, embodiments of the disclosure are not limited thereto, and the first holder 11*aa* may extend from the front to the rear of the inner case 11 so as to be integrally formed with the rear holder 11*e*. The first holder 11*aa* may be formed to entirely support between the front and rear portions of the first ice making case wall 1210*a*. For example, the second holder 11*bb* may extend from the front to the rear of the inner case 11 so as to be integrally formed with the rear holder 11*e*. The second holder 11*bb* may be formed to entirely support between the front and rear portions of the second ice making case wall 1210*b*.

The ice making case 1200 may be fixed to the rear portion of the inner case 11. The ice making case 1200 may include a rear fixed member 1260 fixed to the rear portion of the inner case 11.

For example, the rear fixed member 1260 may be formed to face the cold air supply duct 14 disposed at the rear of the storage compartment 20. The rear fixed member 1260 may be fixed to the cold air supply duct 14 and may be fixed to the rear portion of the inner case 11.

For example, the rear fixed member 1260 may be formed to face the rear wall 11*c* of the inner case 11. The rear fixed member 1260 may be fixed to the rear wall 11*c* of the inner case 11 and may be fixed to the rear portion of the inner case 11.

For example, the rear fixed member 1260 may include a screw hole 1261, and the screw hole 1261 may be penetrated in the front and rear direction by a screw. The rear fixed member 1260 may be fixed to the cold air supply duct 14 or the rear wall 11*c* of the inner case 11 by the screw coupling.

By the rear fixed member 1260, the ice making case 1200 may be more firmly mounted on the inner case 11. The configuration of the rear fixed member 1260 described above is only one example of a configuration for fixing the ice making case 1200 to the inner case 11. The ice making case 1200 may be fixed to the inner case 11 by including various configurations.

The ice making case 1200 may form an exterior of the ice maker 1000. The ice making case 1200 may include a front portion 1230 forming a front surface of the ice making case 1200, and the front portion 1230 may form a front exterior of the ice maker 1000. The front portion 1230 may be formed between the first ice making case wall 1210*a* and the second ice making case wall 1210*b*. The front portion 1230 may connect the first ice making case wall 1210*a* and the second ice making case wall 1210*b*.

The ice making case 1200 may be formed to have a substantially box shape. The ice making case 1200 may be formed to have a box shape with at least one surface open. For example, the ice making case 1200 may have a shape in which a lower portion, that is toward the ice bucket 100, is open. For example, the ice making case 1200 may have a shape in which a rear portion is open. However, embodiments of the disclosure are not limited thereto, and the ice making case 1200 may be formed to have various shapes.

The ice making case 1200 may include a water supplier through member 1250 through which the water supplier 80 passes. The water supplier 80 may supply water to the ice making unit 1300 and the ice making unit 1400.

The water supplier through member 1250 may be formed above the ice making case 1200, but the location of the water supplier through member 1250 is not limited thereto.

The number of water supplier through members 1250 may be provided in accordance with the number of the number of water suppliers, including the water supplier 80, but is not limited thereto. For example, the plurality of water suppliers, including the water supplier, 80 may pass through a single water supplier through member 1250.

The ice maker 1000 may include an ice maker cover 1100. The ice making cover 1100 may be provided to cover the upper side of the ice making case 1200. The ice making cover 1100 may be coupled to an upper portion of the ice making case 1200.

For example, the ice making cover 1100 may be detachably mounted on the ice making case 1200. Alternatively, the ice making cover 1100 may be integrally formed with the ice making case 1200.

The ice making cover 1100 may form an exterior of the ice maker 1000. The ice making cover 1100 may form an upper surface of the ice maker 1000.

The ice making cover 1100 may cover at least a portion of the water supplier 80. Particularly, the ice making cover 1100 may cover at least a portion of the water supplier 80 located inside the storage compartment 20. The ice making cover 1100 may cover the water supplier through member 1250.

The ice making cover 1100 may be disposed above the ice making unit 1300 and the ice making unit 1400. The ice making cover 1100 may cover the upper side of the ice making unit 1300 and the ice making unit 1400.

The ice making unit 1300 and the ice making unit 1400 provided in the ice maker 1000 may be provided to produce various types of ice.

For example, the ice maker 1000 may include the first ice making unit 1300 configured to produce a first type of ice. The first ice making unit 1300 may be supported by a first ice making unit support 1241 of the ice making case 1200.

For example, the ice maker 1000 may include the second ice making unit 1400 configured to produce a second type of ice. The second ice making unit 1400 may be supported by a second ice making unit support 1242 of the ice making case 1200.

The first ice making unit support 1241 may be provided to support at least an upper portion of the first ice making unit 1300. The second ice making unit support 1242 may be provided to support at least an upper portion of the second ice making unit 1400.

The first ice making unit support 1241 may be disposed under the ice making cover 1100. An upper portion of the first ice making unit support 1241 may be covered by the ice making cover 1100. The second ice making unit support 1242 may be disposed under the ice making cover 1100. An upper portion of the second ice making unit support 1242 may be covered by the ice making cover 1100.

The first ice making unit support 1241 and the second ice making unit support 1242 may be disposed between the first ice making case wall 1210*a* and the second ice making case wall 1210*b*. The left and right direction of the first ice making unit support 1241 and the second ice making unit support 1242 may be covered by the first ice making case wall 1210*a* and the second ice making case wall 1210*b*.

The first ice making unit support 1241 and the second ice making unit support 1242 may be disposed behind the front portion 1230. Front portions of the first ice making unit support 1241 and the second ice making unit support 1242 may be covered by the front portion 1230.

The first ice making unit 1300 and the second ice making unit 1400 may be disposed side by side with each other. Similarly, the first ice making unit support 1241 and the second ice making unit support 1242 may be disposed side by side with each other.

For example, the first ice making unit 1300 and the second ice making unit 1400 may be disposed side by side in the left and right directions of the refrigerator 1, and the first ice making unit support 1241 and the second ice making unit support 1242 may be disposed side by side in the left and right directions of the refrigerator 1.

For example, the first ice making unit support 1241 may include a hook structure, and the first ice making unit 1300 may be supported by the first ice making unit support 1241 by the hook coupling. However, embodiments of the disclosure are not limited thereto, and the first ice making unit support 1241 may include various structures for fixing the first ice making unit 1300.

For example, the second ice making unit support 1242 may include a hook structure, and the second ice making unit 1400 may be supported by the second ice making unit support 1242 by the hook coupling. However, embodiments of the disclosure are not limited thereto, and the second ice making unit support 1242 may include various structures for fixing the second ice making unit 1400.

The configuration that allows the ice making unit 1300 and the ice making unit 1400 to be supported by the ice making case 1200 is not limited to the above description. The ice making unit 1300 and the ice making unit 1400 may be supported in various ways.

The first type of ice produced by the first ice making unit 1300 and the second type of ice produced by the second ice making unit 1400 may be different types of ice in terms of shape, size, and the like.

For example, the first type of ice may be ice having a substantially cube shape. For example, the second type of ice may be ice having a substantially spherical shape. Alternatively, the first type of ice and the second type of ice may have similar shapes but different sizes.

However, unlike the above description, the ice maker 1000 may be provided to produce only one type of ice.

The configuration and the operation of the first ice making unit 1300 and the second ice making unit 1400 are described in further detail below.

The ice bucket 100 may be provided in the storage compartment 20. The ice bucket 100 may be mounted on the inner case 11. Particularly, the ice bucket 100 may be supported by the first inner wall 11*a* and the second inner wall 11*b* of the inner case 11.

The ice bucket 100 may be disposed below the ice maker 1000. The ice bucket 100 may be provided to receive ice that is discharged from the ice making unit 1300 and the ice making unit 1400 and moved downward.

For example, the ice bucket 100 may include a first receiving member 110 provided to receive the first type of ice produced by the first ice making unit 1300, and a second receiving member 120 provided to receive the second type of ice produced by the second ice making unit 1400. The first receiving member 110 may be disposed under the first ice making unit 1300. The second receiving member 120 may be disposed under the second ice making unit 1400.

The ice bucket 100 may be seated on the bucket shelf 15. The bucket shelf 15 may be supported by a bucket mounting member 11*d* provided on the first inner wall 11*a* and the second inner wall 11*b* of the inner case 11. The bucket mounting member 11*d* may be formed to extend along the front and rear direction of the inner case 11.

For example, the ice bucket 100 may be inserted into or withdrawn from the storage compartment 20. That is, the ice bucket 100 may be slidably mounted relative to the inner case 11. For example, the bucket shelf 15 may be slidably movable along the bucket mounting member 11*d*. The bucket shelf 15 may be inserted into or withdrawn from the storage compartment 20 along the bucket mounting member 11*d*, and the ice bucket 100 seated on the bucket shelf 15 may be inserted into or withdrawn from the storage compartment 20 together with the bucket shelf 15.

Figure 7:
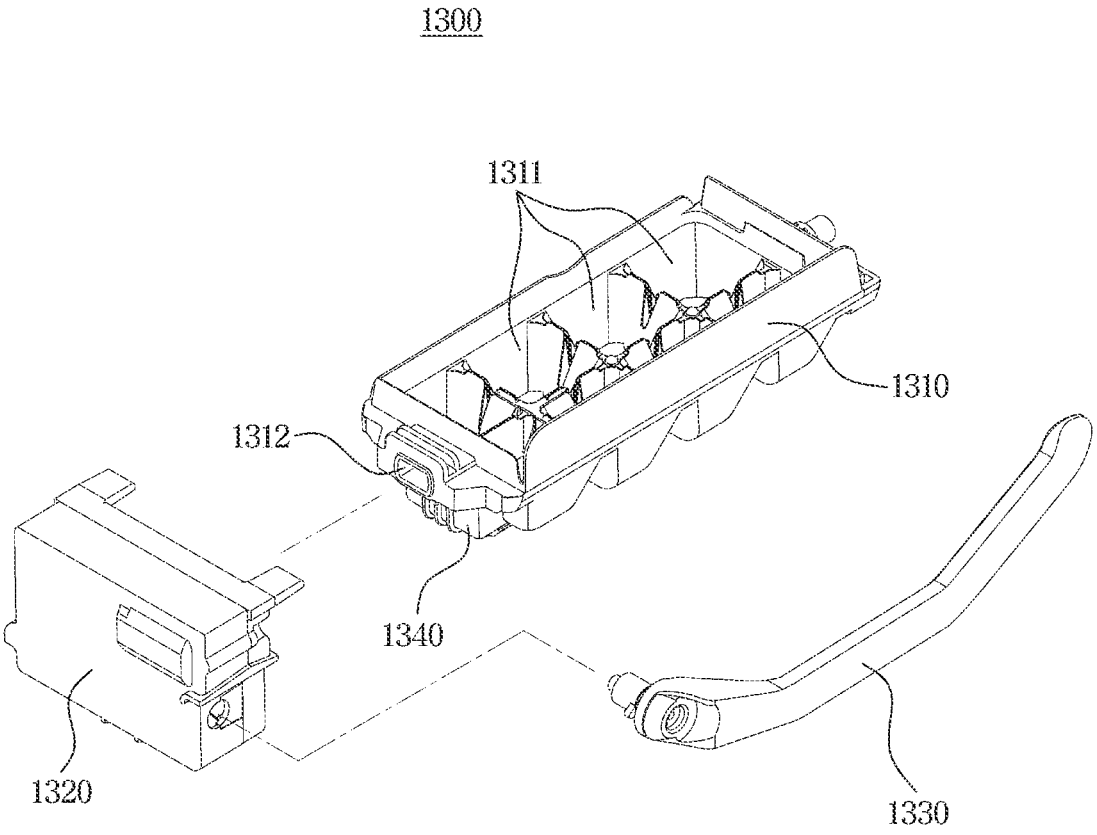
FIG. 7 is an exploded view of a first ice making unit of the refrigerator according to an embodiment of the disclosure.

FIG. 7 is an exploded view of a first ice making unit of the refrigerator according to an embodiment of the disclosure.

Referring to FIG. 7, an example of the first ice making unit 1300 included in the ice maker 1000 of the refrigerator 1 will be described.

Referring to FIG. 7, the first ice making unit 1300 may be configured to produce a first type of ice. For example, the first type of ice may be ice having a substantially cube shape.

The first ice making unit 1300 may include a first ice making tray 1310 in which ice is produced. The first ice making tray 1310 may be provided to receive water from the water supplier 80. The first ice making tray 1310 may be provided to be supported by the first ice making unit support 1241.

The first ice making tray 1310 may include at least one first ice making cell 1311 provided to store water supplied from the water supplier 80. Water stored in the first ice making cell 1311 may be changed into ice by cold air in the storage compartment 20. When a plurality of first ice making cells 1311 is provided as shown in FIG. 7, the plurality of first ice making cells 1311 may be partitioned by a partition wall.

The first ice making tray 1310 and the first ice making cell 1311 may have a shape with one side open. When water is supplied to the first ice making tray 1310 or when water is being frozen, the one open side of the first ice making tray 1310 and the first ice making cell 1311 may be directed to approximately an upper side of the refrigerator 1. When the ice produced in the first ice making tray 1310 is moved to the ice bucket 100, the open side of the first ice making tray 1310 and the first ice making cell 1311 may be directed to approximately a lower side of the refrigerator 1.

The first ice making unit 1300 may include a first driver 1320 configured to move the ice produced in the first ice making tray 1310 to the first receiving member 110 of the ice bucket 100. For example, the first driver 1320 may allow the first ice tray 1310 to be rotated based on a rotational axis in the horizontal direction of the refrigerator 1 so as to allow the ice in the first ice tray 1310 to be transferred to the first receiving member 110.

The first driver 1320 may be coupled to the first ice tray 1310. The first driver 1320 may be coupled to one side of the first ice making tray 1310 with respect to a rotational axis direction. A first driver coupler 1312 may be provided on one side of the first ice making tray 1310 facing the first driver 1320. The first driver coupler 1312 may be provided on the rotation axis of the first ice making tray 1310. The first driver 1320 may be coupled to the first driver coupler 1312.

The first driver 1320 may include a motor, a power transmission member, and the like. The motor of the first driver 1320 may generate power, and the power transmission member may receive power from the motor and transmit the power to the first ice making tray 1310. The power transmission member of the first driver 1320 may be connected to the first driver coupler 1312. The power transmission member of the first driver 1320 may include at least one gear.

The first ice making tray 1310 may be connected to a rotation shaft support 1241*a* provided in the first ice making unit support 1241. The rotation shaft support 1241*a* may be provided on the rotation shaft of the first ice making tray 1310. The rotation shaft support 1241*a* may be disposed at a position opposite to the first drive coupler 1312 with respect to the first ice making tray 1310. The rotation shaft support 1241*a* may rotatably support the first ice making tray 1310.

With the above configuration, the first ice making tray 1310 may receive power from the first driver 1320 and then be rotated based on the rotation axis in the horizontal direction of the refrigerator 1. Ice produced in the first ice making tray 1310 may be discharged from the first ice making cell 1311 according to the rotation of the first ice making tray 1310, and then moved to the first receiving member 110 of the ice bucket 100.

The first ice making unit 1300 may include a full ice detection lever 1330. The full ice detection lever 1330 may be provided to detect whether the first receiving member 110 of the ice bucket 100 disposed under the ice maker 1000 is full of ice.

The full ice detection lever 1330 may be coupled to the first driver 1320. Particularly, the full ice detection lever 1330 may be coupled to a lateral side of the first driver 1320. The full ice detection lever 1330 may be rotatably coupled to the first driver 1320.

When the full ice detection lever 1330 determines that the first receiving member 110 is full of ice, a controller controls the ice maker 1000 to no longer supply water. Accordingly, it is possible to prevent more than necessary ice from being collected in the ice bucket 100.

The first ice making unit 1300 may further include a sensor module 1340. The sensor module 1340 may include a sensor, a case provided to receive the sensor, and an insulator. The sensor module 1340 may be mounted under the first ice tray 1310. The sensor of the sensor module 1340 may be a temperature sensor configured to detect a temperature of the first ice making tray 1310.

When the sensor module 1340 detects that the temperature of the first ice making tray 1310 is less than or equal to a predetermined temperature, the controller may determine that the ice formation on the first ice making tray 1310 is completed. Based on the determination that the ice formation on the first ice making tray 1310 is completed, the controller may control driving of the first driver 1320 to rotate the first ice making tray 1310. Accordingly, ice produced in the first ice making tray 1310 may be collected in the first receiving member 110 of the ice bucket 100 disposed under the first ice making tray 1310.

The configuration of the first ice making unit 1300 described above with reference to FIG. 7 is only an example of the ice making unit provided in the ice-maker of the refrigerator according to the disclosure, and the disclosure is not limited thereto.

Figure 8:
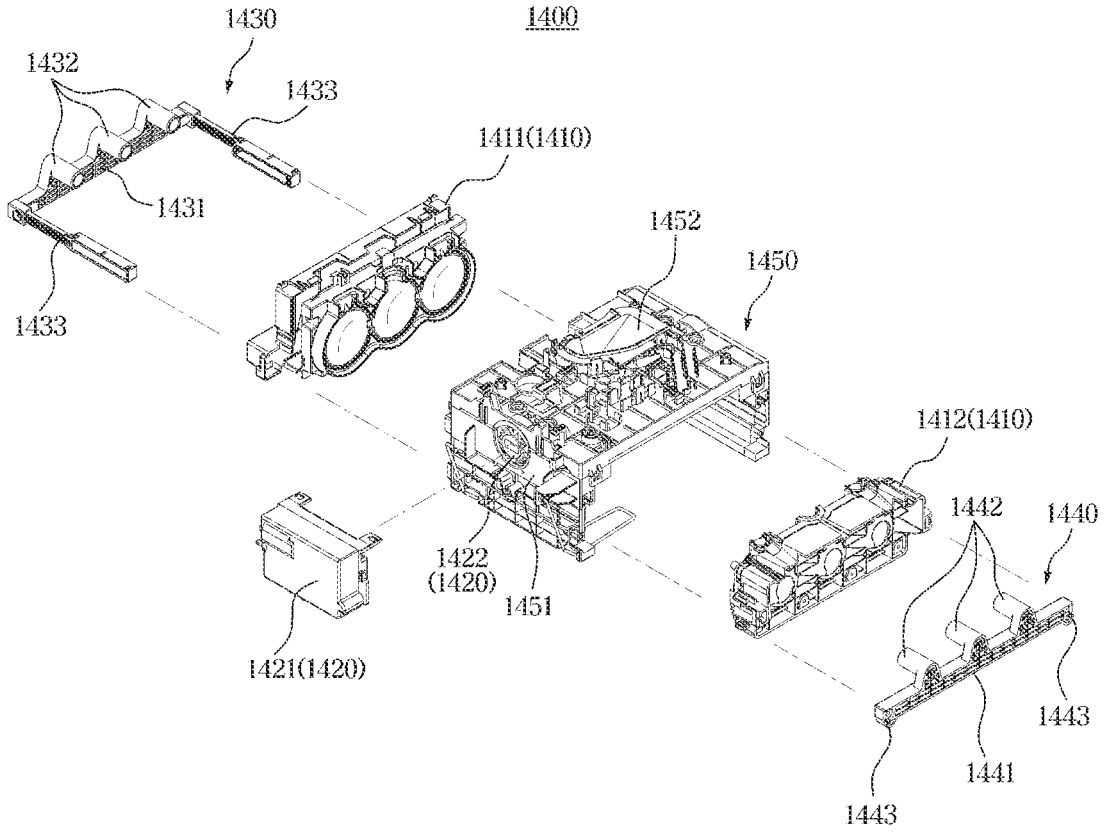
FIG. 8 is an exploded view of a second ice making unit of the refrigerator according to an embodiment of the disclosure.
Figure 9:
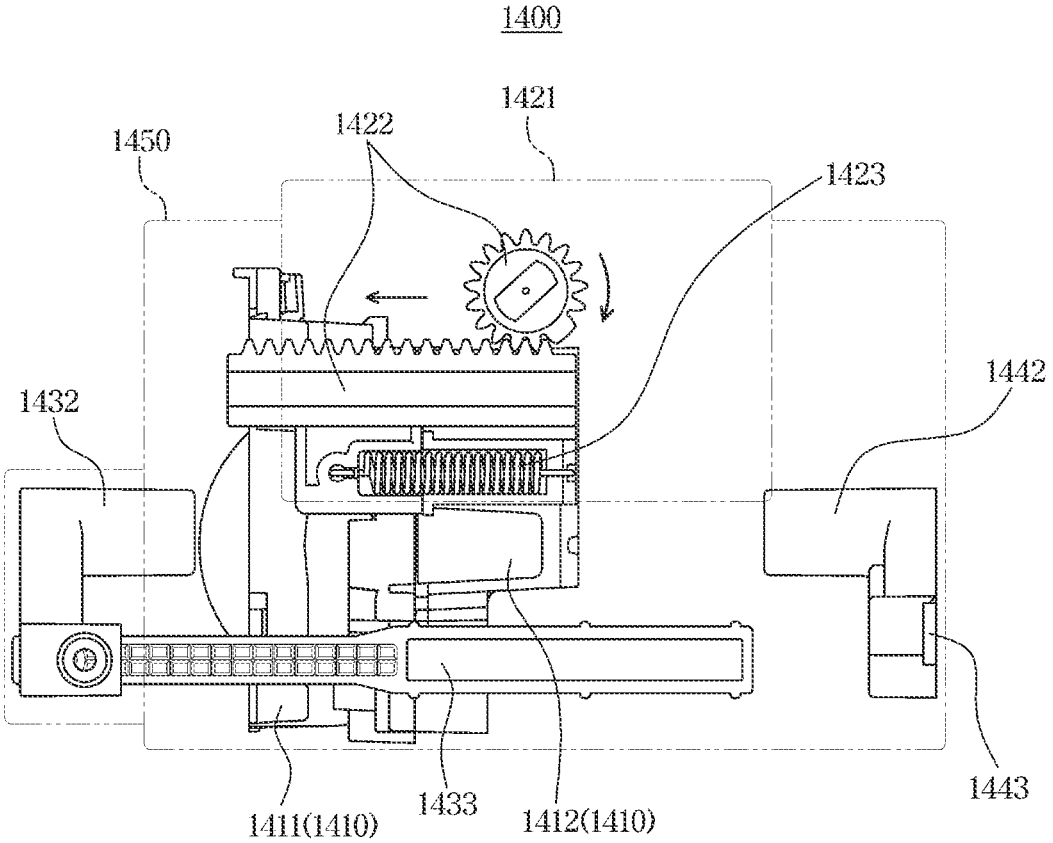
FIG. 9 is a view illustrating an operation of the second ice making unit of the refrigerator according to an embodiment of the disclosure.
Figure 10:
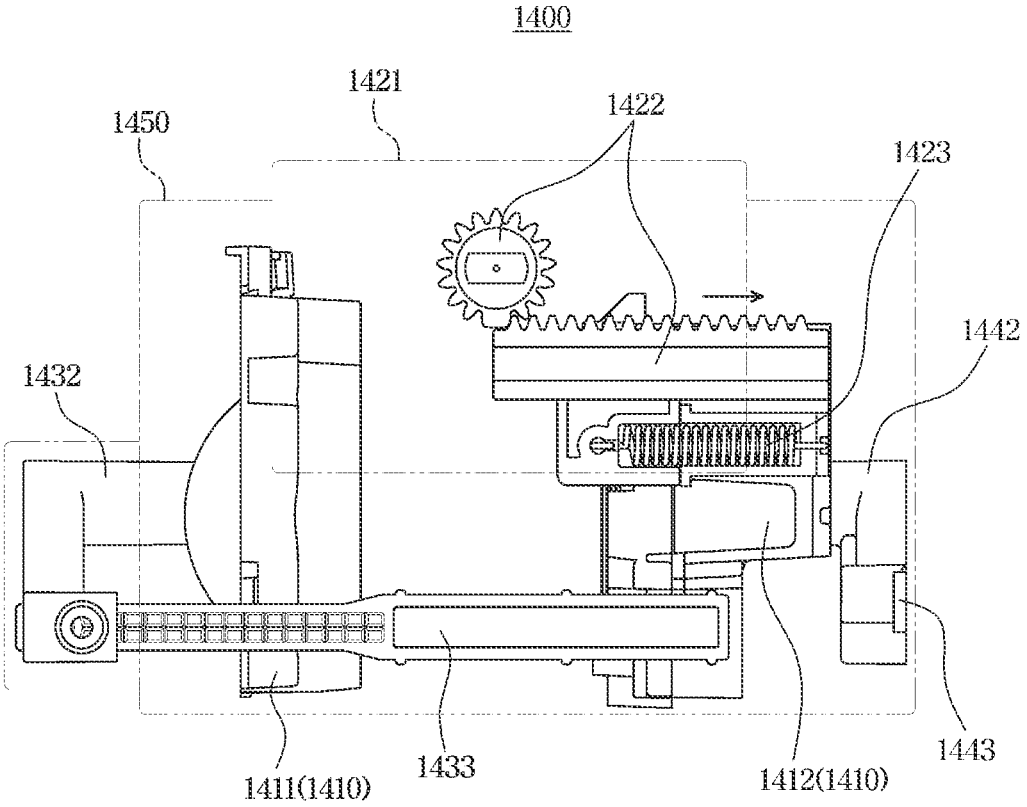
FIG. 10 is a view illustrating an operation of the second ice making unit of the refrigerator according to an embodiment of the disclosure.
Figure 11:
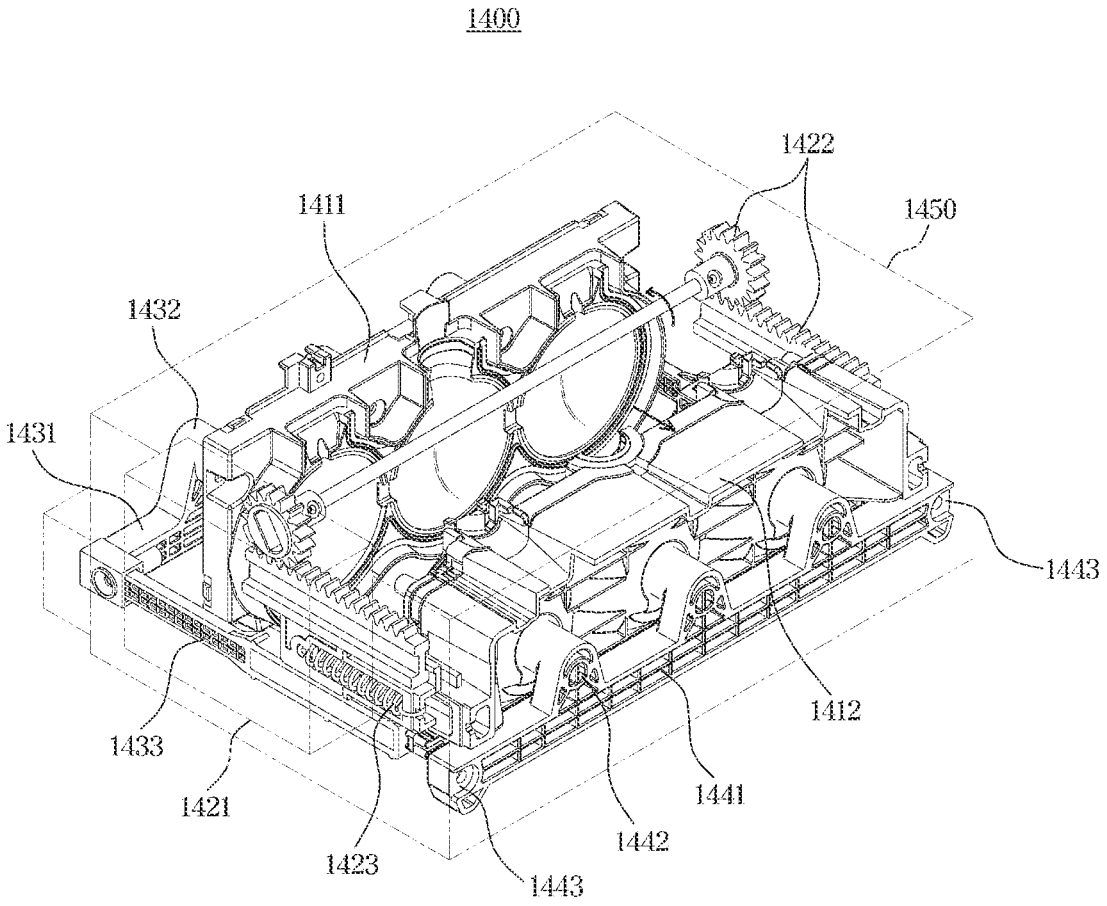
FIG. 11 is a view illustrating an operation of the second ice making unit of the refrigerator according to an embodiment of the disclosure.

FIG. 8 is an exploded view of a second ice making unit of the refrigerator according to an embodiment of the disclosure. FIG. 9 is a view illustrating an operation of the second ice making unit of the refrigerator according to an embodiment of the disclosure. FIG. 10 is a view illustrating an operation of the second ice making unit of the refrigerator according to an embodiment of the disclosure. FIG. 11 is a view illustrating an operation of the second ice making unit of the refrigerator according to an embodiment of the disclosure.

An example of the second ice making unit 1400 included in the ice maker 1000 of the refrigerator 1 will be described with reference to FIG. 8, FIG. 9, FIG. 10, and FIG. 11.

Referring to FIG. 8, FIG. 9, FIG. 10, and FIG. 11, the second ice making unit 1400 may be configured to produce a second type of ice having a substantially spherical shape.

The second ice making unit 1400 may include a second ice making tray 1410 in which ice is produced.

The second ice making tray 1410 may include at least one second ice making cell provided to store water supplied from the water supplier 80 (refer to FIG. 2). Water stored in the second ice making cell may be changed into ice by cold air in the storage compartment 20. The second ice making cell may be provided inside the second ice making tray 1410. The second ice making cell may include an elastic material. The second ice making cell may be provided to be elastically deformable.

The second ice making unit 1400 may include a cover frame 1450 covering the outside of the second ice making tray 1410. The cover frame 1450 may be supported by the second ice making unit support 1242. The second ice making tray 1410 may be supported by the cover frame 1450.

The cover frame 1450 may include a water collector 1452 for receiving water from the water supplier 80. The water collector 1452 may be provided to collect water supplied from the water supplier 80 and supply the water to the second ice making tray 1410.

As shown in FIG. 8, FIG. 9, FIG. 10, and FIG. 11, the second ice making tray 1410 may be configured to simultaneously produce a plurality of second types of ice. A plurality of second ice making cells may be provided inside the second ice making tray 1410. For example, a plurality of water collectors 1452 may be provided to correspond to the number of the plurality of second ice making cells, and may supply collected water to each of the plurality of second ice making cells. For example, the water collector 1452 may supply the collected water to only a part of the plurality of second ice making cells, and an inside of the plurality of second ice making cells may communicate with each other so as to allow the collected water to be supplied to all of the second ice making cells.

The second ice making tray 1410 may include a fixed tray 1411 and a movable tray 1412. The fixed tray 1411 and the movable tray 1412 may be supported by the cover frame 1450.

The fixed tray 1411 may maintain a fixed position relative to the cover frame 1450. The movable tray 1412 may be provided to be movable relative to the cover frame 1450. Particularly, the movable tray 1412 may be provided to be movable between the fixed tray 1411 and a ejector 1440.

A portion of the second ice making cell corresponding to approximately a half of the second ice making cell may be provided in the fixed tray 1411. A remaining portion corresponding to approximately the other half of the second ice making cell may be provided inside the movable tray 1412. The portion of the second ice making cell inside the fixed tray 1411 and the other portion of the second ice making cell inside the movable tray 1412 may each have a substantially hemispherical shape.

The second ice making unit 1400 may include a second driver 1420 configured to supply power to allow the movable tray 1412 to be moved relative to the cover frame 1450, and ejector 1430 and ejector 1440 configured to discharge ice, which is produced in the second ice making tray 1410, from the second ice making tray 1410.

The second driver 1420 may include a motor configured to generate power, a motor case 1421 provided to receive the motor, and a power transmission member 1422 configured to transmit power generated from the motor. For example, the motor of the second driver 1420 may generate power that is rotated with respect to the rotation axis in the horizontal direction of the refrigerator 1.

The motor case 1421 may be coupled to the cover frame 1450. The motor case 1421 may be coupled to a second driver coupler 1451 provided on the cover frame 1450. A hole provided to penetrate the cover frame 1450 may be formed in the second driver coupler 1451, and the hole of the second driver coupler 1451 may be disposed on the rotation shaft connected to a motor of the second driver 1420.

The power transmission member 1422 may be connected to the motor of the second driver 1420 to receive power generated by the motor. The power transmission member 1422 may transmit power received from the motor to the movable tray 1412. For example, the power transmission member 1422 may include at least one gear.

The power transmission member 1422 may be configured to convert a rotational motion by the motor of the second driver 1420 into a linear motion and transmit the linear motion to the movable tray 1412. For example, the power transmission member 1422 may include a pinion gear and a rack gear. The pinion gear of the power transmission member 1422 may be connected to a rotation shaft of the motor of the second driver 1420. The pinion gear of the power transmission member 1422 may be engaged with the rack gear, and a rotational motion of the pinion gear may be converted into a linear motion of the rack gear.

The rack gear of the power transmission member 1422 may be coupled to the movable tray 1412. By the linear motion of the rack gear, the movable tray 1412 may be provided to perform a linear motion with respect to the cover frame 1450.

The power transmission member 1422 may further include an elastic member 1423. The elastic member 1423 may couple the rack gear of the power transmission member 1422 to the movable tray 1412. For example, the elastic member 1423 may be an elastic spring.

The ejector 1430 and ejector 1440 of the second ice making unit 1400 may include a first ejector, as the ejector 1430, and a second ejector, as the ejector 1440. The ejector 1430 may be arranged at a position adjacent to the fixed tray 1411. The ejector 1440 may be arranged at a position adjacent to the movable tray 1412. The second ice making tray 1410 may be disposed between the ejector 1430 and the ejector 1440.

The ejector 1430 may be configured to be moved relative to the cover frame 1450. The ejector 1430 may be configured to be moved based on the movement of the movable tray 1412.

The ejector 1430 may include a first body 1431, a first pressing member 1432 and a leg 1433.

The first body 1431 may be formed to extend in a direction parallel to the movable tray 1412. That is, the first body 1431 may extend in a direction perpendicular to a moving direction of the ejector 1430.

The first pressing member 1432 may be provided to extend from the first body 1431. The first body 1431 may be provided to support the first pressing member 1432. The first pressing member 1432 may be provided to press the second ice making cell inside the fixed tray 1411 by penetrating the fixed tray 1411.

The leg 1433 may extend from opposite ends of the first body 1431 and be inserted into the lateral side of the cover frame 1450. The leg 1433 may extend in a direction parallel to a moving direction of the first ejector 1430. The leg 1433 may be provided as a symmetrical pair.

When the movable tray 1412 is moved in a direction away from the fixed tray 1411, the ejector 1430 may be moved along the moving direction of the movable tray 1412. That is, because the fixed tray 1411 is disposed between the first ejector 1430 and the movable tray 1412, the ejector 1430 may be moved in a direction of being close to the fixed tray 1411.

When the movable tray 1412 is moved in a direction of being close to the fixed tray 1411, the ejector 1430 may be also moved along the moving direction of the movable tray 1412. That is, because the fixed tray 1411 is disposed between the ejector 1430 and the movable tray 1412, the ejector 1430 may be moved in a direction away from the fixed tray 1411.

For example, the movable tray 1412 may include an interference member provided to interfere with the leg 1433 of the ejector 1430. According to the movement of the movable tray 1412, the interference member of the movable tray 1412 and the leg 1413 may interfere with each other and thus the ejector 1430 may be also moved together.

When the ejector 1430 is moved toward the fixed tray 1411, the first pressing member 1432 of the ejector 1430 may pass through the fixed tray 1411 and press the second ice making cell inside the fixed tray 1411.

The ejector 1440 may be fixed to one side of the cover frame 1450.

The ejector 1440 may include a second body 1441, a second pressing member 1442 and a frame coupler 1443. The second body 1441 may extend in a direction parallel to the movable tray 1412. The second pressing member 1442 may extend from the second body 1441 toward the movable tray 1412. The frame coupler 1443 may be formed at opposite ends of the second body 1441 and coupled to the cover frame 1450.

The ejector 1440 may maintain a fixed position relative to the cover frame 1450, and may be provided to press the movable tray 1412 when the movable tray 1412 is moved toward the ejector 1440. Particularly, the ejector 1440 may be provided to press the second ice making cell inside the movable tray 1412 when the movable tray 1412 is moved toward the ejector 1440.

As illustrated in FIG. 9, when the second ice making tray 1410 produces ice using water supplied from the water supplier 80, the fixed tray 1411 and the movable tray 1412 may be positioned to be coupled to each other. At the position in which the fixed tray 1411 and the movable tray 1412 are coupled, a portion of the second ice making cell inside the fixed tray 1411 and the other portion of the second ice making cell inside the movable tray 1412 may be coupled to form the integrated second ice making cell. Accordingly, the second type of ice may be produced inside the second ice making cell.

After the production of the second type of ice is completed, as shown in FIG. 11, the controller may control driving of the second driver 1420 to allow the movable tray 1412 to be moved toward the ejector 1440. When power is generated from the motor of the second driver 1420, the generated power may be transmitted to the movable tray 1412 through the power transmission member 1422. The movable tray 1412 may be separated from the fixed tray 1411 and moved linearly toward the ejector 1440.

When the movable tray 1412 approaches, the second pressing member 1442 of the ejector 1440 may pass through the movable tray 1412 and press a part of the second ice making cell inside the movable tray 1412. When a part of the second ice making cell inside the movable tray 1412 is pressed by the second pressing member 1442, the part of the second ice making cell inside the movable tray 1412 may be elastically deformed, and the second type of ice located therein may be discharged from the movable tray 1412. The second type of ice discharged from the movable tray 1412 may be moved to the second receiving member 120 of the ice bucket 100.

When the movable tray 1412 is moved further in the same direction while a part of the second ice making cell inside the movable tray 1412 is pressed by the second pressing member 1442, the interference member of the movable tray 1412 may interfere with the leg 1433 and thus the first ejector 1430 may be moved toward the fixed tray 1411. Accordingly, the first pressing member 1432 of the first ejector 1430 may pass through the fixed tray 1411 and press the other portion of the second ice making cell inside the fixed tray 1411. The other portion of the second ice making cell inside the fixed tray 1411 may be elastically deformed by being pressed by the second pressing unit 1432, and the second type of ice located therein may be discharged from the fixed tray 1411. The second type of ice discharged from the fixed tray 1411 may be moved to the second receiving member 120 of the ice bucket 100.

With the above configuration, ice produced in the second ice making tray 1410 may be discharged from the second ice making tray 1410 and moved to the second receiving member 120 of the ice bucket 100.

The configuration of the second ice making unit 1400 described above with reference to FIG. 8, FIG. 9, FIG. 10, and FIG. 11 is only one example of the ice making unit provided in the ice maker of the refrigerator according to the disclosure, and the disclosure is not limited thereto.

In addition, the structure of the indirect cooling type-ice maker, in which cold air generated in the storage compartment 20 is guided toward the ice maker 1000 to cool water supplied to the first tray 1310 and the second tray 1410, has been described with reference to FIG. 1, FIG. 2, FIG. 3, FIG. 4, FIG. 5, FIG. 6, FIG. 7, FIG. 8, FIG. 9, FIG. 10, and FIG. 11, as an example of the ice maker of the refrigerator according to an embodiment. However, the disclosure is not limited thereto, and the disclosure may be applied to a configuration of the direct cooling type-ice maker in which a separate refrigerant pipe is disposed in the first ice making tray 1310 and the second ice making tray 1410 to directly supply cold air so as to cool water supplied to the first ice making tray 1310 and the second ice making tray 1410.

Figure 12:
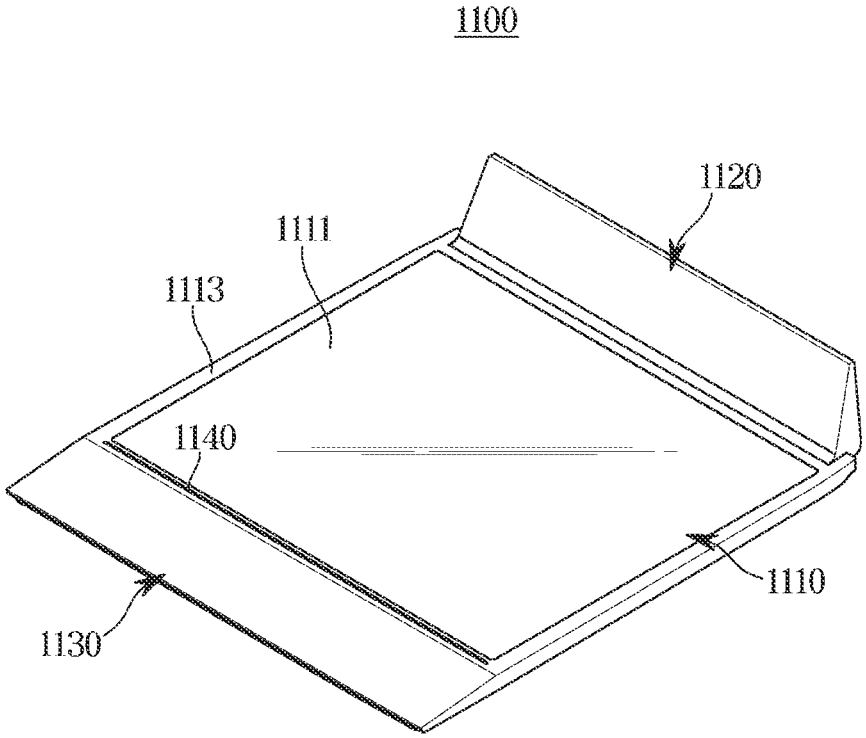
FIG. 12 is a perspective view of an ice making cover of the refrigerator according to an embodiment of the disclosure.
Figure 13:
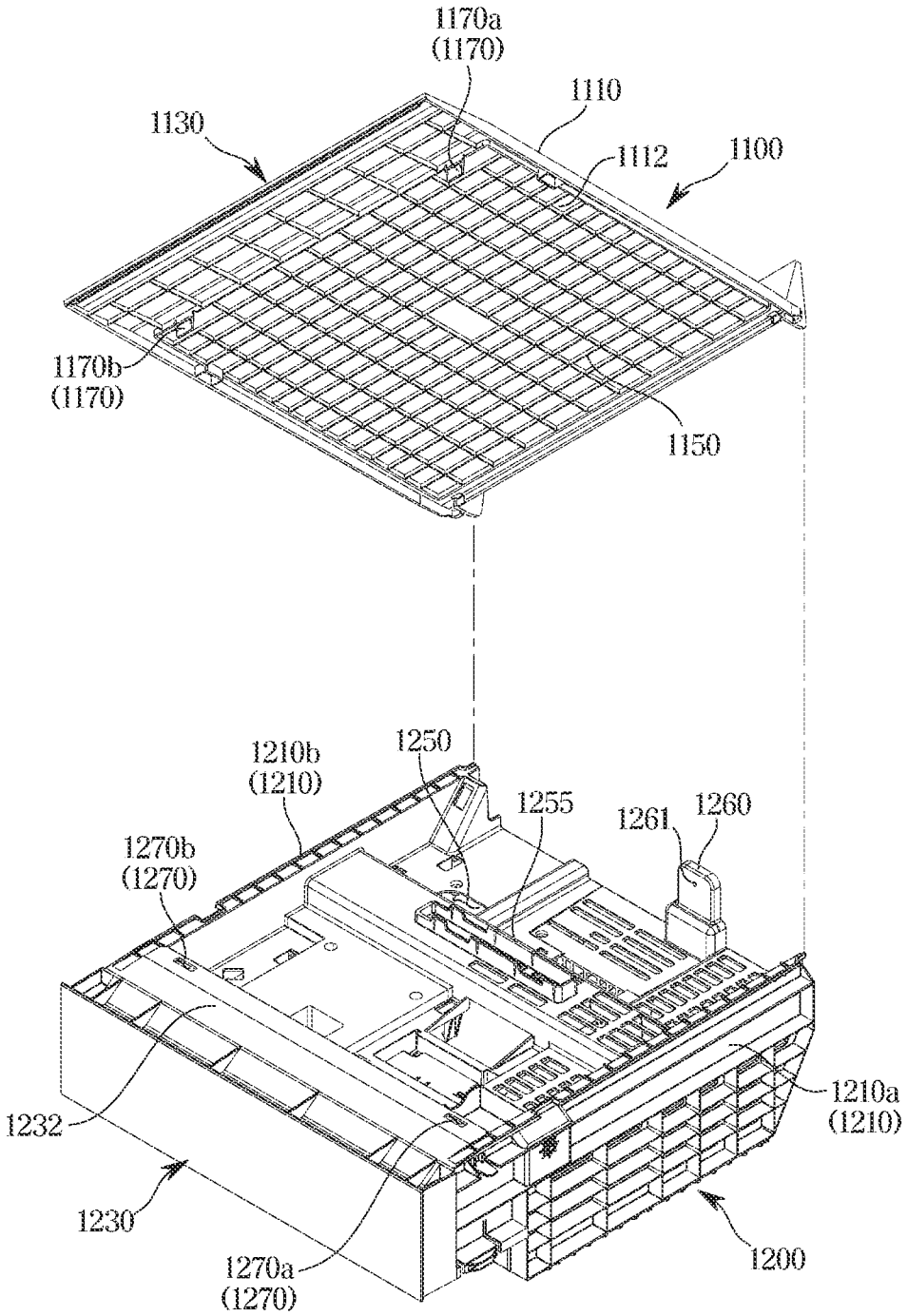
FIG. 13 is a bottom perspective view of the ice making cover and a perspective view of an ice making case illustrating a coupling between the ice making cover and the ice making case of the refrigerator according to an embodiment of the disclosure.
Figure 14:
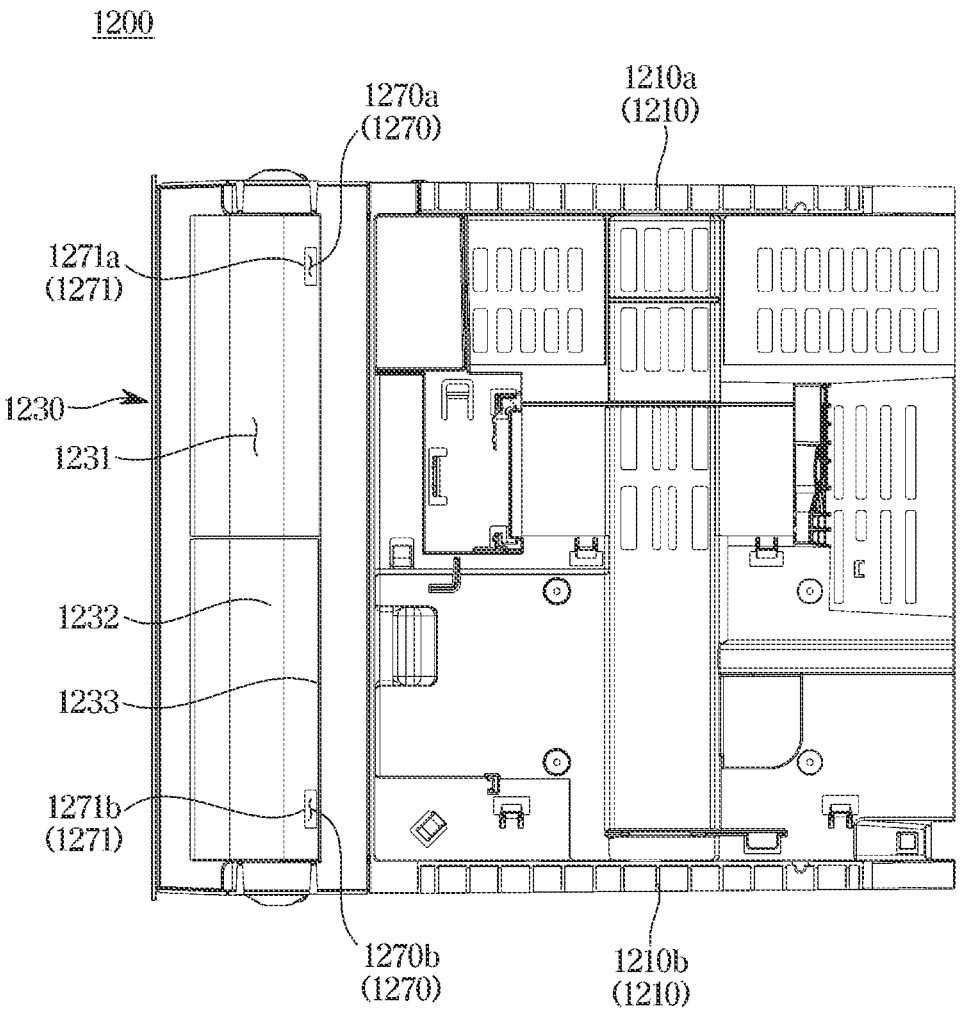
FIG. 14 is a bottom view of the ice making case of FIG. 13.

FIG. 12 is a perspective view of an ice making cover of the refrigerator according to an embodiment of the disclosure. FIG. 13 is a bottom perspective view of the ice making cover and a perspective view of an ice making case illustrating a coupling between the ice making cover and the ice making case of the refrigerator according to an embodiment of the disclosure. FIG. 14 is a bottom view of the ice making case of FIG. 13.

Referring to FIG. 12, FIG. 13, and FIG. 14, the ice making cover 1100 may cover the upper side of the ice making case 1200. The ice making cover 1100 may include a shelf member 1110 provided to cover the ice making case 1200 while supporting an item provided on an upper side thereof. The ice making cover 1100 may include the front inclined member 1130 extending forward from the shelf member 1110 and a rear inclined member 1120 extending backward from the shelf member 1110.

The shelf member 1110 may be formed in a substantially rectangular plate shape. The shelf member 1110 may have a predetermined thickness to allow an item to be placed on the upper side. The shelf member 1110 may include a rectangular support surface 1111 on which an item is supported, and an edge surface 1113 disposed around the support surface 1111.

A rear surface 1112 of the support surface 1111 may be a surface facing the ice making case 1200. A reinforcing rib 1150 protruding from the rear surface 1112 toward the ice making case 1200 may be formed on the rear surface 1112 of the support surface 1112. The reinforcing rib 1150 may be provided to reinforce the rectangular shelf member 1110. The reinforcing rib 1150 may be provided in a frame shape in the left and right direction.

A guide rib 1140 may be formed on a front side of the edge surface 1113. The guide rib 1140 may be formed to protrude upward from the edge surface 1113 adjacent to the front inclined member 1130. The guide rib 1140 may extend in the left and right direction.

The front inclined member 1130 may extend forward from the shelf member 1110. The front inclined member 1130 may have a shape inclined downward to the front side. The front inclined member 1130 may be disposed adjacent to the inclined wall 11*f* (refer to FIG. 1). The front inclined member 1130 may be disposed adjacent to the protruding upper surface 11*ga* of the inclined protruding wall 11*g*. The front inclined member 1130 may be provided to be seated in the ice making case 1200.

Meanwhile, the front inclined member 1130 may be provided to correspond to the inclined shape of the inclined protruding wall 11*g*. That is, because the inclined shape of the front inclined member 1130 is inclined upward to the rear side, it is possible to give a harmonious aesthetic feeling with the inclined protruding wall 11*g*.

The front inclined member 1130 may give the harmonious aesthetic feeling with the inclined protruding wall 11*g*, and guide a user to prevent placing an item on the upper side of the front inclined member 1130.

The rear inclined member 1120 may be a part in contact with the cold air supply duct 14 (refer to FIG. 2). The rear inclined member 1120 may have a shape that is inclined upward to the rear side. This is to allow the rear inclined member 1120 to be supported by the cold air supply duct 14 and to cover the water supplier 80 that is inclined downward as the water supplier 80 passes through the cold air supply duct 14 and goes forward.

That is, the ice making cover 1100 may be formed not only to support an item and to cover the ice making case 1200, but also to improve the aesthetics of the front and rear sides of the storage compartment 20. The ice making cover 1100 may be detachably coupled to the ice making case 1200.

A fixing protrusion 1170 to be coupled to the ice making case 1200 may be provided on a bottom surface of the ice making cover 1100. The fixing protrusion 1170 may be provided on the front side of the shelf member 1110 and may protrude downward. The fixing protrusion 1170 may include a first fixing protrusion 1170*a* and a second fixing protrusion 1170*b* spaced apart from each other in the left and right direction. The first fixing protrusion 1170*a* and the second fixing protrusion 1170*b* may be spaced apart from each other in a direction perpendicular to the direction in which the ice making cover 1100 is inserted into the storage compartment 20.

The ice making case 1200 may include the front portion 1230 forming the front surface. The front portion 1230 may be disposed between the first ice making case wall 1210*a* and the second ice making case wall 1210*b*, and formed in a rectangular shape.

The ice making case 1200 may include an open member 1231 formed behind the front portion 1230. The ice making case 1200 may include a cover coupler 1232 formed to support the ice making cover 1100 and be coupled to the ice making cover 1100. The ice making case 1200 may include an open partition 1233 extending downward from the cover coupler 1232. The open partition 1233 and the front portion 1230 may be spaced apart from each other in the front and rear direction and disposed side by side.

The open member 1231 may be formed between the open partition 1233 and the front portion 1230. The cover coupler 1232 may be provided on the upper side of the open member 1231, and thus the cover coupler 1232 may form an upper portion of the open member 1231, and the open member 1231 may be formed to open downward.

The ice making case 1200 may include a shelf support 1255 provided between the first ice making case wall 1210*a* and the second ice making case wall 1210*b*. The shelf support 1255 may be disposed behind the cover coupler 1232 and spaced apart from the cover coupler 1232.

The shelf support 1255 may protrude upward to support the ice making cover 1100. Particularly, the shelf member 1110 may be spaced apart from the shelf support 1255 in the vertical direction, but when the shelf member 1110 is bent due to a weight of an item arranged on the upper side, the shelf member 1110 may be supported by the shelf support 1255.

Meanwhile, the ice making case 1200 may include an insertion hole 1270 formed in the cover coupler 1232 to allow the fixing protrusion 1170 to be inserted thereinto. The insertion hole 1270 may include a first insertion hole 1270*a* adjacent to the first ice making case wall 1210*a* and a second insertion hole 1270*b* adjacent to the second ice making case wall 1210*b*. The first insertion hole 1270*a* and the second insertion hole 1270*b* may be formed to be spaced apart from each other in the left and right direction.

Figure 15:
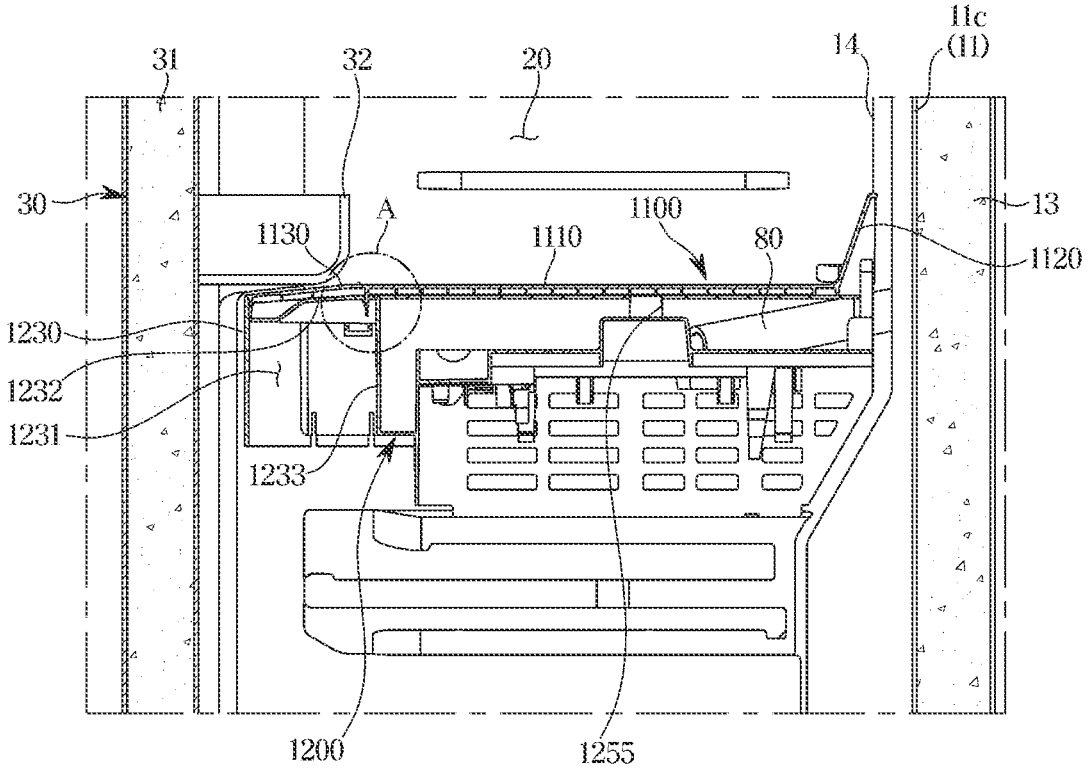
FIG. 15 is a side cross-sectional view of the ice making cover coupled to the ice making case according to an embodiment of the disclosure.
Figure 16:
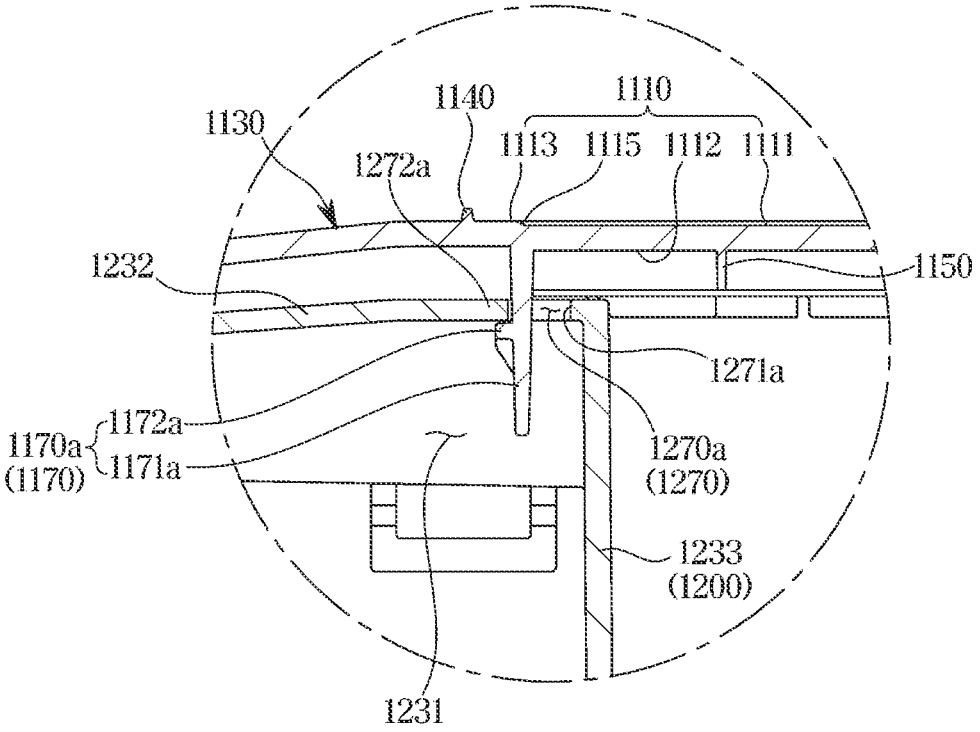
FIG. 16 is an enlarged view of portion A shown in FIG. 15.

FIG. 15 is a side cross-sectional view of the ice making cover coupled to the ice making case according to an embodiment of the disclosure. FIG. 16 is an enlarged view of portion A shown in FIG. 15.

Referring to FIG. 15 and FIG. 16, the ice making cover 1100 may be provided to cover the upper side of the ice making case 1200, and the ice making cover 1100 may be detachably coupled to the ice making case 1200.

The ice making cover 1100 may include the shelf member 1110 provided to cover the upper side of the ice making case 1200 and the fixing protrusion 1170 protruding from the shelf member 1110 toward the ice making case 1200. The ice making cover 1100 may be fixed to the ice making case 1200 as the fixing protrusion 1170 is inserted into the insertion hole 1270.

Hereinafter a configuration and coupling relationship between the first fixing protrusion 1170*a* and the first insertion hole 1270*a* may correspond to a configuration and coupling relationship between the second fixing protrusion 1170*b* and the second insertion hole 1270*b*. Accordingly, the configuration of the first fixing protrusion 1170*a* and the first insertion hole 1270*a* will be described in detail, and the configuration of the second fixing protrusion 1170*b* and the second insertion hole 1270*b* may be understood similarly.

The first fixing protrusion 1170*a* may include a first insertion member 1171*a* extending in the vertical direction and formed to be inserted into the first insertion hole 1270*a*, and a hooking member 1172*a* extending forward from the first insertion member 1171*a*. The first insertion member 1171*a* may protrude downward from the shelf member 1110. Because the first insertion member 1171*a* supporting the first fixing protrusion 1170*a* has elasticity, the first insertion member 1171*a* may be bent in the front and rear direction and then return to its original position.

An edge 1271*a* of the first insertion hole 1270*a* may be formed around the first insertion hole 1270*a*. The edge 1271*a* may form the first insertion hole 1270*a*. A first locking protrusion 1272*a* may be formed on a front edge of the edge 1271*a* of the first insertion hole 1270*a*. The first locking protrusion 1272*a* may be formed to lock the first hooking member 1172*a*.

When the first fixing protrusion 1170*a* is inserted into the first insertion hole 1270*a*, the first insertion member 1171*a* having elasticity and the first hooking member 1172*a* may be pushed backward and be inserted into the first insertion hole 1270*a*. After the first hooking member 1172*a* is inserted into the first insertion hole 1270*a*, the first insertion member 1171*a* and the first hooking member 1172*a* may be moved forward due to the characteristics that returns to its original position. Therefore, the first hooking member 1172*a* may be locked to the first locking protrusion 1272*a*.

The first insertion member 1171*a* may pass through the first insertion hole 1270*a*, and the first hooking member 1172*a* may be disposed below the first locking protrusion 1272*a*, and an upward-movement thereof may be prevented by the first locking protrusion 1272*a*. Accordingly, the first fixing protrusion 1170*a* may be inserted into the first insertion hole 1270*a* and prevented from being withdrawn upward again, and thus the ice making cover 1100 may be fixed to the upper side of the ice making case 1200.

The guide rib 1140 may serve as a guide line to prevent interference with the door shelf 32. The guide rib 1140 may protrude upward from the edge surface 1113. The guide rib 1140 may be disposed in front of the support surface 1111. The guide rib 1140 may be disposed in front of the support surface 1111.

Meanwhile, as the door 30 is closed, the door shelf 32 may be inserted into the storage compartment 20, and particularly, inserted up to the position of the guide rib 1140. When an item is placed on the front side of the guide rib 1140, the item may be pushed backward and spilled due to the door shelf 32. In order to prevent this, the guide rib 1140 may protrude upward from the shelf member 1110 so as to be visually confirmed by a user, and thus the user can place an item on the rear side of the guide rib 1140 inside the storage compartment 20. That is, the guide rib 1140 may be a rib that serves as a guide to allow a user to more safely place an item on the upper side of the ice making cover 1100.

The shelf member 1110 may include the support surface 1111 recessed downward from the edge surface 1113, and a stepped member 1115 may be formed between the support surface 1111 and the edge surface 1113. The stepped member 1115 may be formed between the support surface 1111 and the edge surface 1113 to correspond to a position, in which the fixing protrusion 1170 protrudes, with respect to the front and rear direction of the inner case 11 (refer to FIG. 2). The stepped member 1115 may be provided to prevent the shelf member 1110 from contracting as the fixing protrusion 1170 protrudes downward from the shelf member 1110. In addition, the support surface 1111 may contract downward due to the configuration of the reinforcing rib 1150, but in order to prevent a user from losing the aesthetic feeling, a corrosion surface may be formed by applying friction to the support surface 1111 so as to prevent the reflection of the light.

Reinforcing ribs, including the reinforcing rib 1150, may be spaced apart from each other in the vertical direction from the ice making case 1200. The shelf member 1110 disposed above the reinforcing rib 1150 may be disposed to be spaced apart from the ice making case 1200. This is to prevent an impact, which is caused by a weight of an item placed on the upper side of the shelf member 1110, from being applied to the first ice making unit 1300 (refer to FIG. 5) and the second ice making unit 1400 in which the shelf member 1110 is supported by the ice making case 1200.

Figure 17:
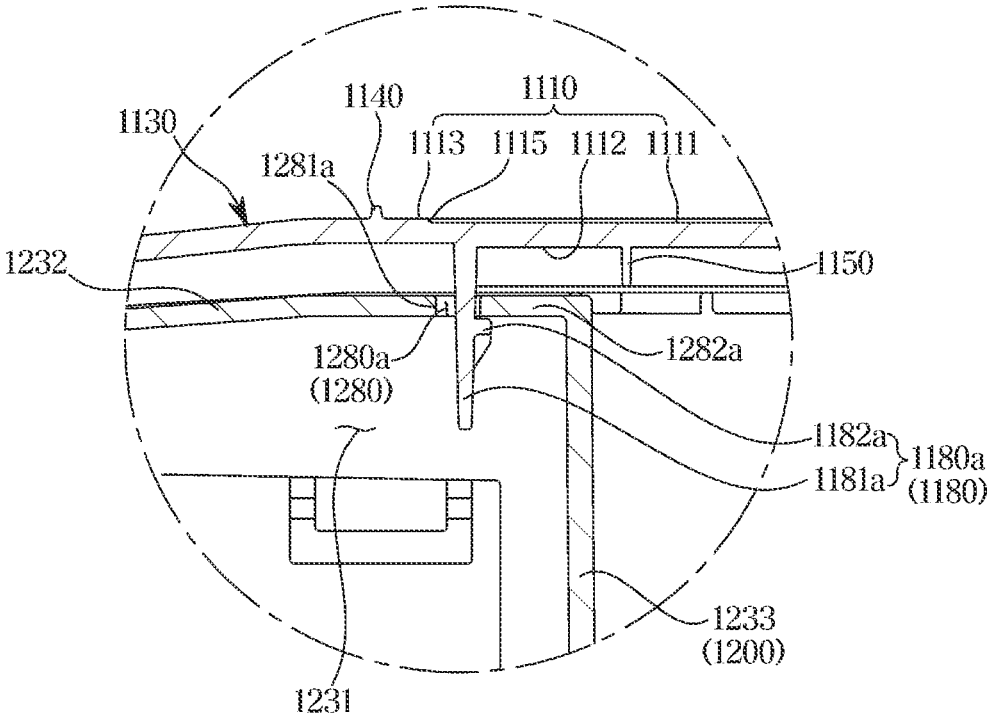
FIG. 17 is an enlarged-side cross-sectional view illustrating a coupling of an ice making cover and an ice making case according to an embodiment of the disclosure.

FIG. 17 is an enlarged-side cross-sectional view illustrating a coupling of an ice making cover and an ice making case according to an embodiment of the disclosure. Referring to FIG. 17, a first hooking member 1182*a* according to an embodiment may be formed to protrude backward from a first insertion member 1181*a* of a first fixing protrusion 1180*a*.

A first locking protrusion 1282*a* may be provided on an edge 1281*a* disposed at the rear side among an edge 1281*a* of a first insertion hole 1280*a* of the ice making case 1200. The first hooking member 1182*a*, which is insertable into the first insertion hole 1280*a* without an interference with the first locking protrusion 1282*a* due to elasticity, may return to the rear side and then locked to the first locking protrusion 1282*a*, and thus the ice making cover 1100 may be more stably coupled to the upper side of the ice making case 1200.

The first locking protrusion 1282*a* and the open partition 1230 may be spaced apart from each other. This is because, when the ice making cover 1100 (refer to FIG. 15) is dissembled from the ice making case 1200, it is easier than otherwise to apply a force to allow the first insertion member 1181*a* supporting the first hooking member 1182*a* to be bent forward.

Figure 18:
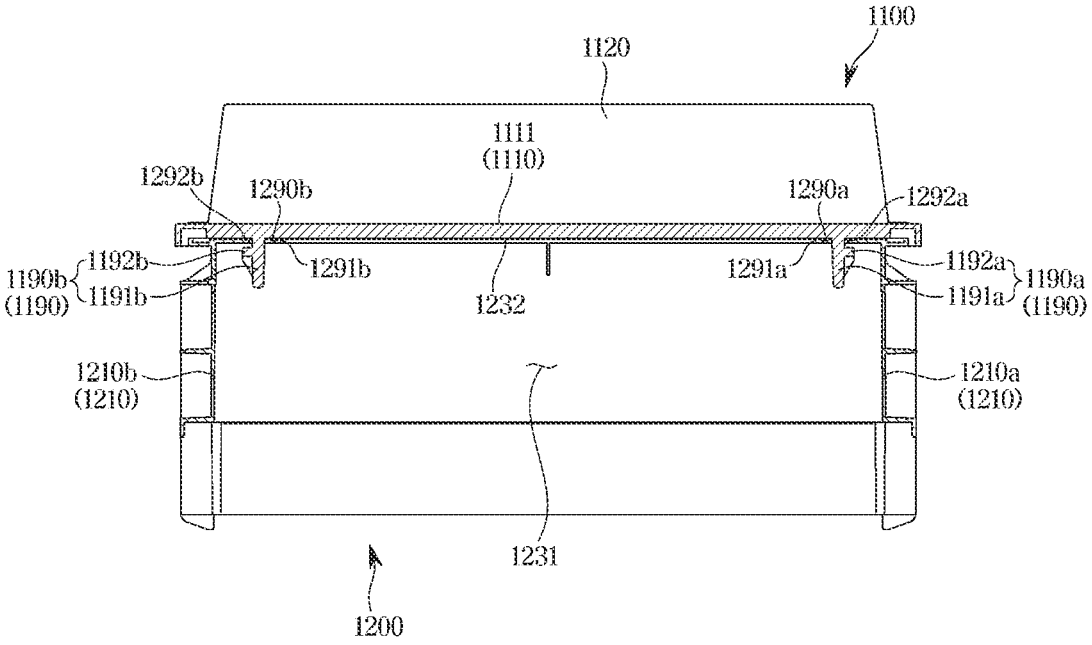
FIG. 18 is a front cross-sectional view illustrating a coupling of an ice making cover and an ice making case according to an embodiment of the disclosure.

FIG. 18 is a front cross-sectional view illustrating a coupling of an ice making cover and an ice making case according to an embodiment of the disclosure. Referring to FIG. 18, a fixing protrusion 1190 of the ice making cover 1100 may include a first fixing protrusion 1190*a* and a second fixing protrusion 1190*b*.

The first fixing protrusion 1190*a* may be spaced apart from the second fixing protrusion 1190*b* with respect to the left and right direction, and the first fixing protrusion 1190*a* may be disposed adjacent to a first ice making case wall 1210*a* and inserted into a first insertion hole 1290*a*. The second fixing protrusion 1190*b* may be disposed adjacent to a second ice making case wall 1210*b* and inserted into a second insertion hole 1290*b*.

The first fixing protrusion 1190*a* may include a first insertion member 1191*a* inserted into the first insertion hole 1290*a* and a first hooking member 1192*a* protruding from the first insertion member 1191*a* toward the first ice making case wall 1210*a*.

The second fixing protrusion 1190*b* may include a second insertion member 1191*b* inserted into the second insertion hole 1290*b* and a second hooking member 1192*b* that is directed from the second insertion member 1191*b* toward the second ice making case wall 1210*b*. The second hooking member 1192*b* may extend in a direction opposite to the protruding direction of the first hooking member 1192*a*.

A first locking protrusion 1292*a* may be formed on an edge 1291*a* adjacent to the first ice making case wall 1210*a* among an edge 1291*a* of the first insertion hole 1290*a*. Similarly, a second locking protrusion 1292*b* may be formed on an edge 1291*b* adjacent to the second ice making case wall 1210*b* among an edge 1291*b* of the second insertion hole 1290*b*.

The first locking protrusion 1292*a* may be adjacent to the first inner wall 11*a* (refer to FIG. 1), and the second locking protrusion 1292*b* may be adjacent to the second inner wall 11*b*.

With this structure, the ice making cover 1100 may be stably supported on the upper side of the ice making case 1200 and even when the ice making cover 1100 is dissembled from the ice making case 1200, the first hooking member 1192*a* and the second hooking member 1192*b* may be pressed in a direction of being close to each other and thus the first hooking member 1192*a* and the second hooking member 1192*b* may be withdrawn from the first insertion hole 1290*a* and the second insertion hole 1290*b*.

Figure 19:
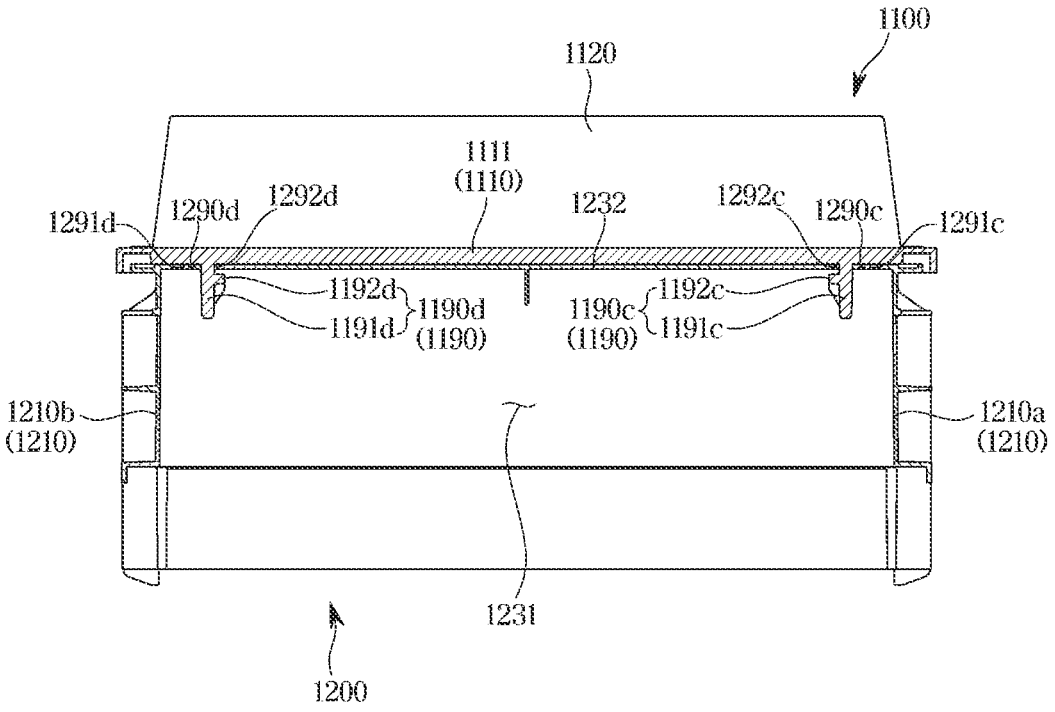
FIG. 19 is a front cross-sectional view illustrating a coupling of an ice making cover and an ice making case according to an embodiment of the disclosure.

FIG. 19 is a front cross-sectional view illustrating a coupling of an ice making cover and an ice making case according to an embodiment of the disclosure.

Referring to FIG. 19, a first fixing protrusion 1190*c* may include a first hooking member 1192*c* protruding from a first insertion member 1191*c* toward the second ice making case wall 1210*b*. The first hooking member 1192*c* may protrude from the first insertion member 1191*c* toward the second inner wall 11*b*.

A second fixing protrusion 1190*d* may include a second hooking member 1192*b* protruding from a second insertion member 1191*d* toward the first ice making case wall 1210*a* or the first inner wall 11*a*.

A first locking protrusion 1292*c* may be formed on an edge 1291*c* adjacent to the second ice making case wall 1210*b* among an edge 1291*c* of the first insertion hole 1290*c*. Similarly, a second locking protrusion 1292*d* may be formed on the edge 1291*d* adjacent to the first ice making case wall 1210*a* among the edge 1291*d* of the second insertion hole 1290*d*.

With this structure, the ice making cover 1100 may be stably supported on the upper side of the ice making case 1200, and even when the ice making cover 1100 is dissembled from the ice making case 1200, the first hooking member 1192*c* and the second hooking member 1192*d* may be pressed in a direction away from each other and thus the first hooking member 1192*c* and the second hooking member 1192*d* may be withdrawn from the first insertion hole 1290*c* and the second insertion hole 1290*d*.

Figure 20:
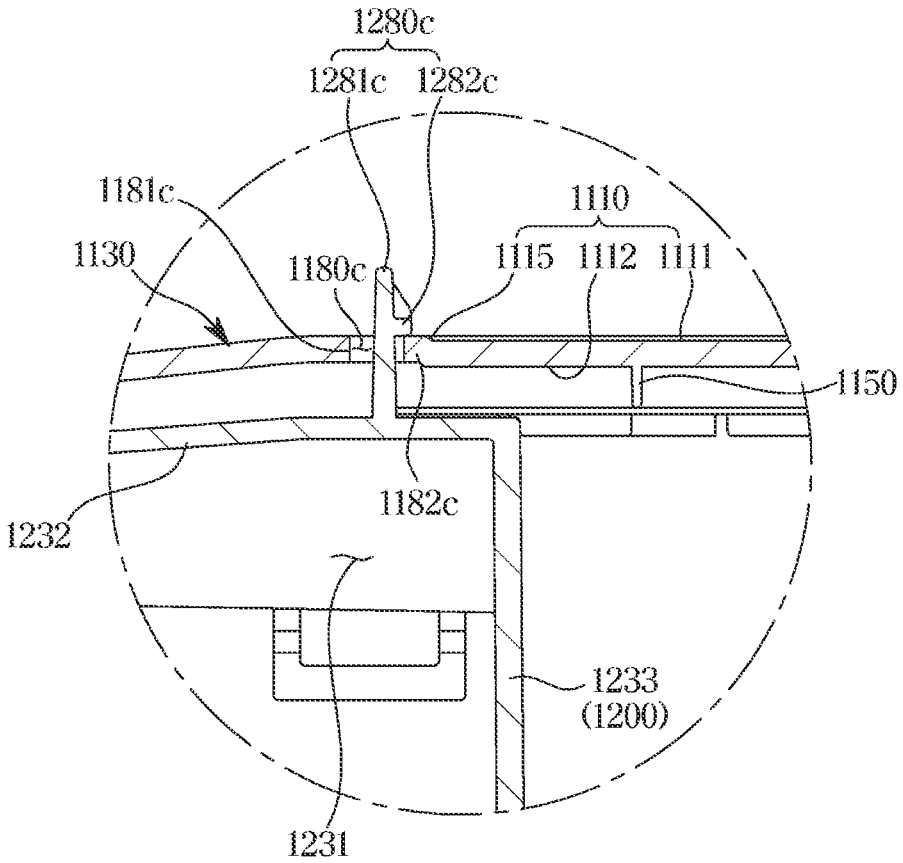
FIG. 20 is an enlarged-side cross-sectional view illustrating a coupling of an ice making cover and an ice making case according to an embodiment of the disclosure.

FIG. 20 is an enlarged-side cross-sectional view illustrating a coupling of an ice making cover and an ice making case according to an embodiment of the disclosure.

Referring to FIG. 20, the ice making case 1200 may include a fixing protrusion 1280. The fixing protrusion 1280 may include a first fixing protrusion 1280*c* and a second fixing protrusion.

The ice making cover 1100 may include a first insertion hole 1180*c* provided in the front of the shelf member 1110 and a second insertion hole. The first insertion hole 1180*c* may be provided behind the front inclined member 1130 and may be formed to allow a first fixing protrusion 1280*c* to be inserted thereinto.

The first fixing protrusion 1280*c* may include a first insertion member 1281*c* protruding upward from the cover coupler 1232 to pass through the first insertion hole 1180*c*, and a first hooking member 1282*c* protruding from the first insertion member 1281*c* to the rear side.

A first locking protrusion 1182*c* may be provided in an edge 1181*c* provided at the rear side among an edge 1181*c* of the first insertion hole 1180*c*, and the first hooking member 1282*c* may be locked to the first locking protrusion 1182*c*.

With this structure, as the first fixing protrusion 1280*c* is inserted into the first insertion hole 1180*c*, the first fixing protrusion 1280*c* may fix the ice making cover 1100 to the upper side of the ice making case 1200 and at the same time, the first fixing protrusion 1280*c* may serve as the guide rib 1140, which is different from the structure shown in FIG. 15.

Further, it is not limited to those shown in the drawings, and the first hooking member 1282*c* may protrude forward from the first insertion member 1281*c*, and the first locking protrusion 1182*c* may be provided at a front edge among the edge 1181*c* of the first insertion hole 1180*c*.

Figure 21:
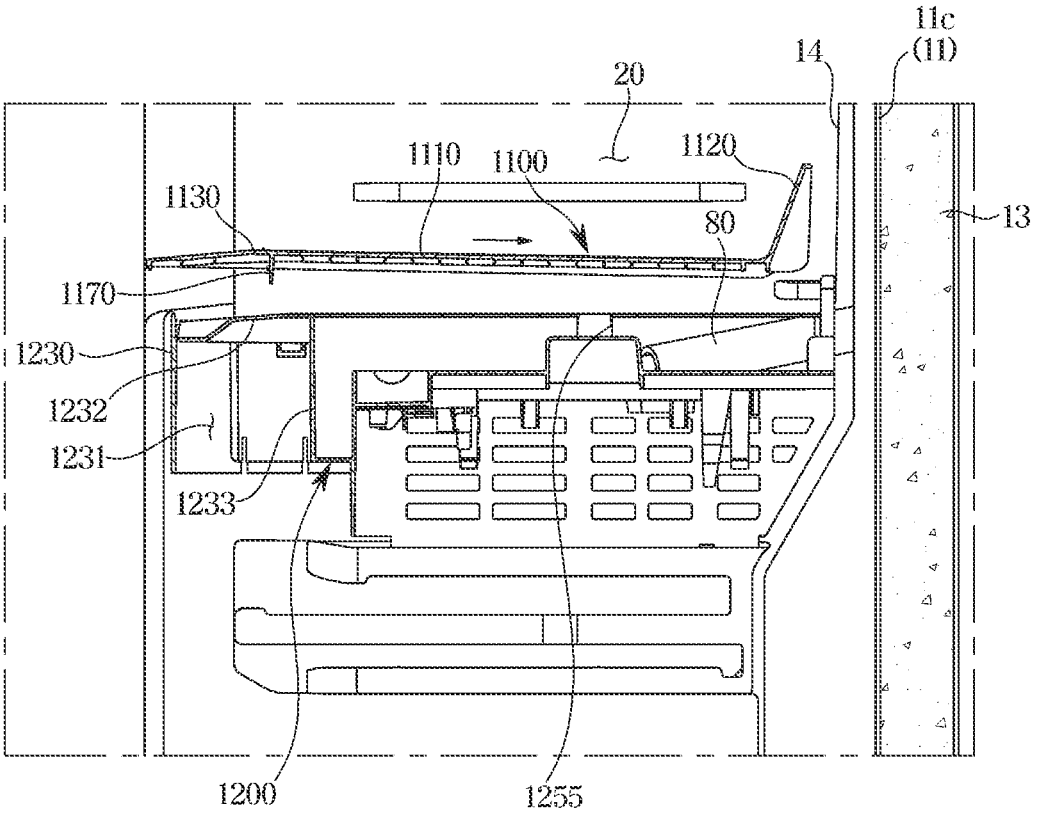
FIG. 21 is a side cross-sectional view illustrating a state in which the ice making cover according to an embodiment of the disclosure is inserted into an inner case of the refrigerator.
Figure 22:
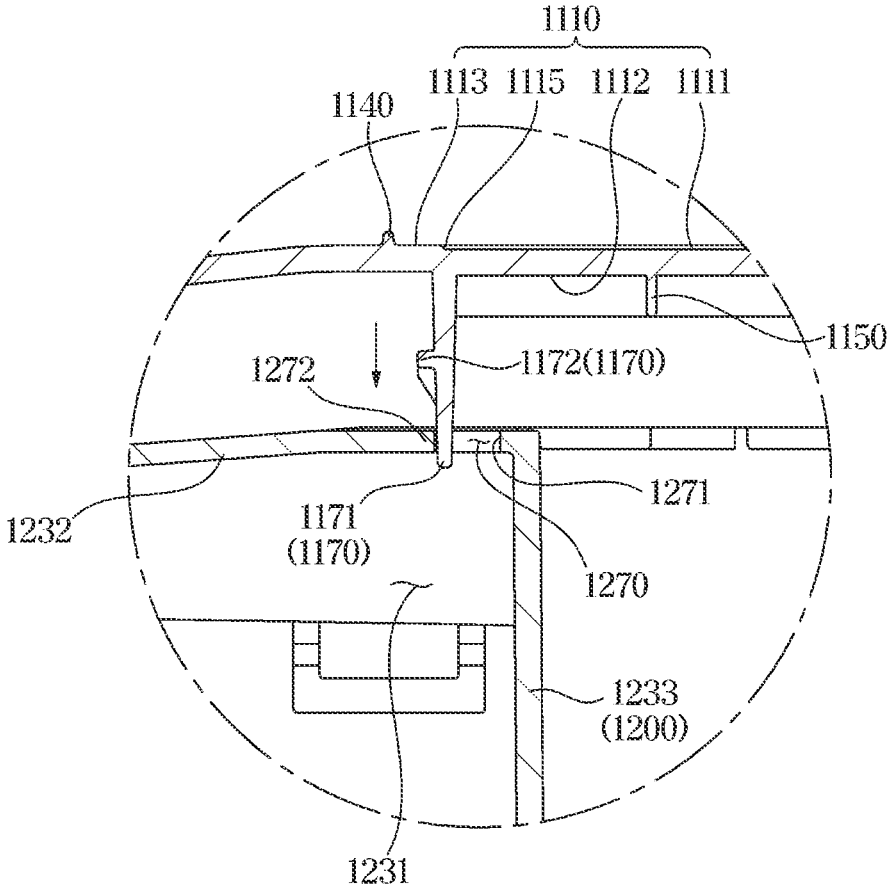
FIG. 22 is an enlarged side cross-sectional view illustrating a state in which a fixing protrusion of the ice making cover inserted into the inner case of the refrigerator of FIG. 21 is inserted toward a coupling groove.
Figure 23:
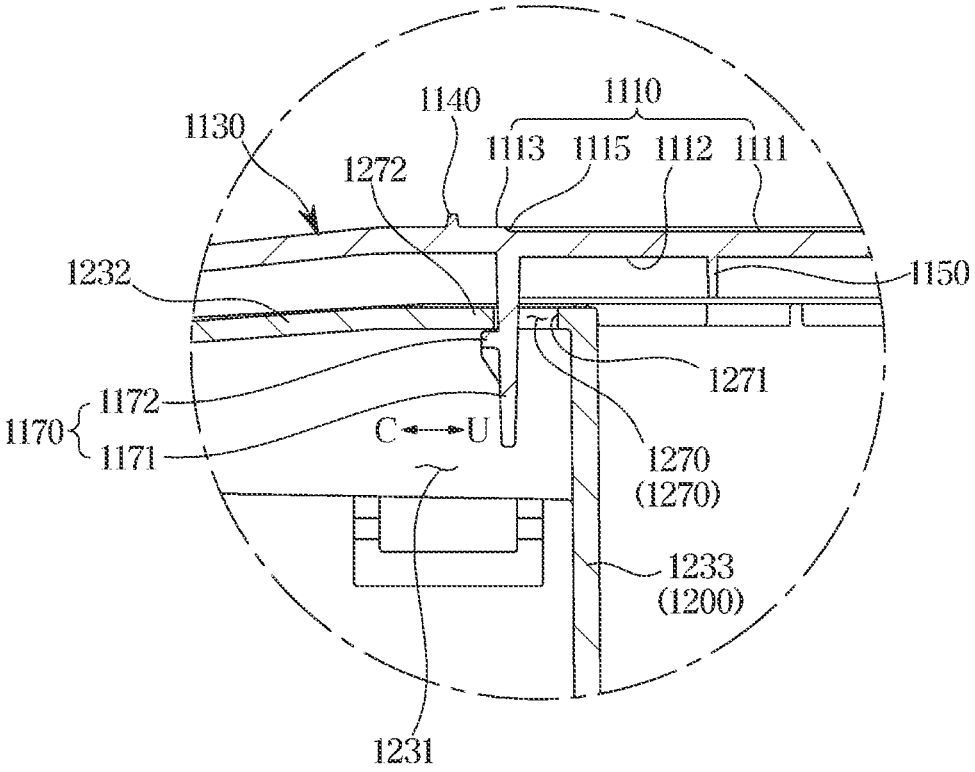
FIG. 23 is an enlarged view illustrating the fixing protrusion inserted into the coupling groove of FIG. 22 and locked to a locking protrusion.

FIG. 21 is a side cross-sectional view illustrating a state in which the ice making cover according to an embodiment of the disclosure is inserted into an inner case of the refrigerator. FIG. 22 is an enlarged side cross-sectional view illustrating a state in which a fixing protrusion of the ice making cover inserted into the inner case of the refrigerator of FIG. 21 is inserted toward a coupling groove. FIG. 23 is an enlarged view illustrating the fixing protrusion inserted into the coupling groove of FIG. 22 and locked to a locking protrusion.

Referring to FIG. 21, FIG. 22, and FIG. 23, in a state in which the door 30 (refer to FIG. 1) is open, the ice making cover 1100 may be inserted into the storage compartment 20 toward the cold air supply duct 14. When the rear inclined member 1120 is seated in the cold air supply duct 14, the front inclined member 1130 may be seated toward the ice making case 1200.

As the fixing protrusion 1170 is moved downward, the insertion member 1171 inserted into the insertion hole 1270 and the hooking member 1172 extending forward from the insertion member 1171 may interfere with the locking protrusion 1272 and be bent backward. As the hooking member 1172 is bent backward, the hooking member 1172 may be inserted into the insertion hole 1270, and the hooking member 1172 may return to the front position (direction C) due to the property of elasticity that returns to its original position. As the hooking member 1172 returning to the front side is disposed below the locking protrusion 1272, the ice making cover 1100 may be disposed on the upper side of the ice making case 1200 and it is possible to prevent the ice making cover 1100 from being disassembled from the upper side of the ice making case 1200.

When the ice making cover 1100 is disassembled from the ice making case 1200 for the replacement or repair of the configuration of the first ice making unit 1300 (refer to FIG. 5) and the second ice making unit 1400, the insertion member 1171 may be pressed backward (direction U) to prevent the interference between the hooking member 1172 and the locking protrusion 1272.

When the hooking member 1172, which is bent backward, passes through the insertion hole 1270 and moves upward, the ice making cover 1100 may be disengaged from the ice making case 1200.

Figure 24:
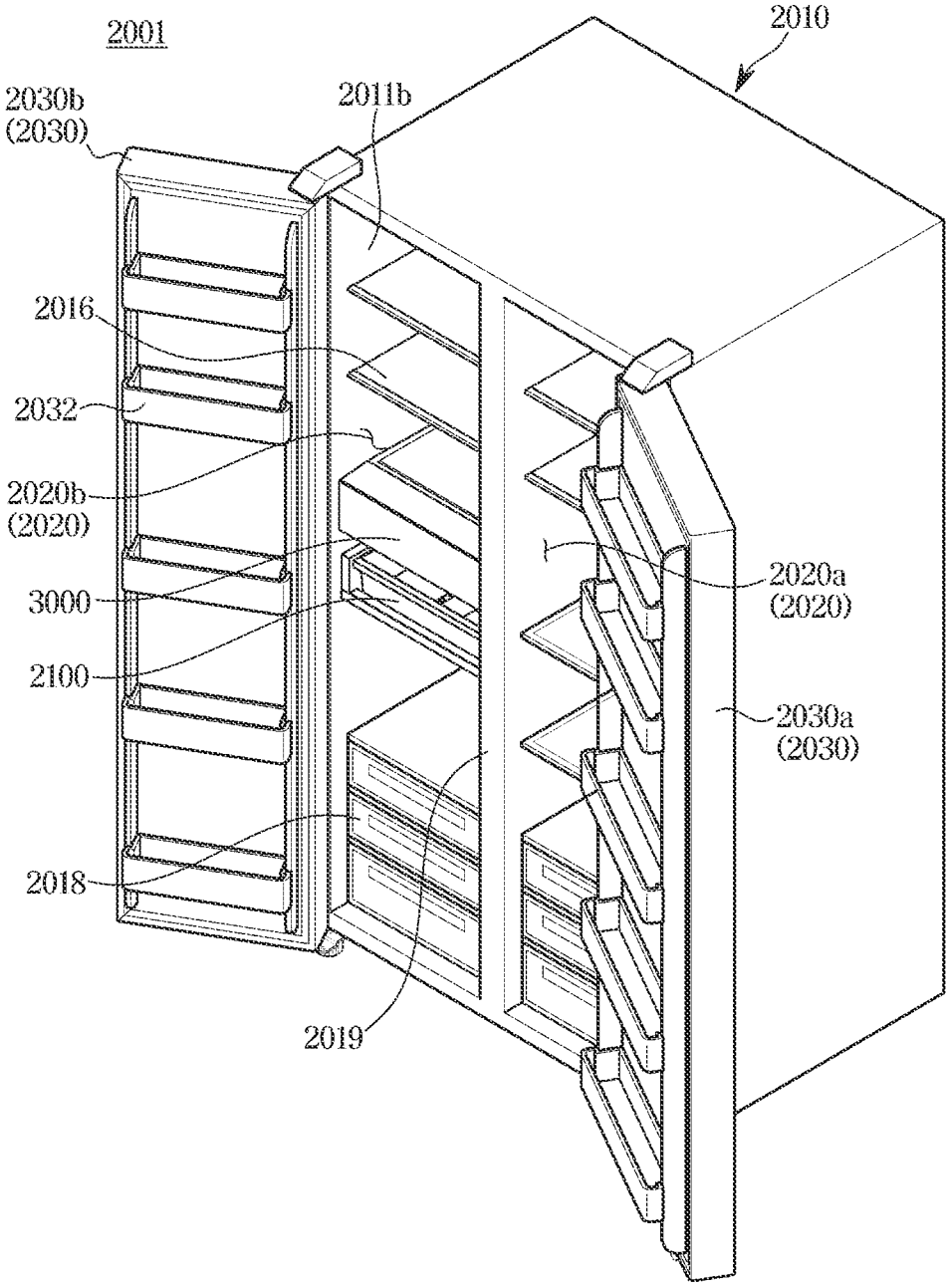
FIG. 24 is a perspective view of a refrigerator according to an embodiment of the disclosure.

FIG. 24 is a perspective view of a refrigerator according to an embodiment of the disclosure.

Referring to FIG. 24, a refrigerator 2001 according to an embodiment may be of a side-by-side (SBS) type in which a refrigerating compartment and a freezing compartment are disposed on the left and right sides. The refrigerator 1 may include a main body 2010, a storage compartment 2020 provided inside the main body 2010, a door 2030 configured to open and close the storage compartment 2020, and a cooling system configured to supply cold air to the storage compartment 2020.

The storage compartment 2020 may include a first storage compartment 2020*a* and a second storage compartment 2020*b*. The door 2030 may include a first door 2030*a* configured to open and close the first storage compartment 2020*a* and a second door 2030*b* configured to open and close the second storage compartment 2020*b*.

The first storage compartment 2020*a* may be a refrigerating compartment, and the second storage compartment 2020*b* may be a freezing compartment. However, embodiments of the disclosure are not limited thereto. The first storage compartment 2020*a* and the second storage compartment 2020*b* may be partitioned left and right by a vertical partition 2019.

The refrigerator 2001 may include an ice maker 3000 configured to produce ice using cold air in the storage compartment 20. The ice maker 3000 may include an ice maker cover and an ice maker case.

The ice making case may be supported by a second inner wall 2011*b* and the vertical partition 2019. However, embodiments of the disclosure are not limited thereto.

The refrigerator 2001 may include an ice bucket 2100 disposed below the ice maker 3000. The ice bucket 2100 may receive ice discharged from the ice making unit and moved downward, and the ice bucket 2100 may be seated on a bucket shelf. The bucket shelf may be supported by the second inner wall 2011*b* and the vertical partition 2019, but is not limited thereto.

Unlike the ice making cover shown in FIG. 12, the ice making cover may include a shelf member and a rear inclined member without a front inclined member. This is to prevent interference with items accommodated in a door shelf 2032. The coupling of the ice making cover and the ice making case may correspond to the above description. The fixing protrusion of the ice making cover may be disposed more forward than that shown in FIG. 15, and the insertion groove and the open partition may be relatively further spaced apart from each other than those shown in FIG. 15.

As is apparent from the above description, because an ice making cover is easily coupled to and disassembled from an ice making case in an ice-maker, it is easy to replace and repair internal components of the ice maker.

Further, an ice making cover serves as a shelf, it is possible to store relatively more items in a storage compartment.

Additional aspects of the disclosure will be set forth in part in the description which follows and, in part, will be obvious from the description, or may be learned by practice of the disclosure.

Although certain example embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an outer case forming an exterior of the refrigerator;

an inner case comprising a first inner wall and a second inner wall opposite to the first inner wall; and an ice maker mounted on the inner case and configured to produce ice, the ice maker comprising an ice making case and an ice making cover covering an upper side of the ice making case, wherein the ice making case is supported by the first inner wall and the second inner wall, wherein the ice making cover is detachably coupled to the ice making case and configured to support an item on an upper side of the ice making cover, wherein the ice making cover comprises:

a shelf member, covering the ice making case, and a first fixing protrusion protruding from the shelf member toward the ice making case, wherein the ice making case comprises a first insertion hole into which the first fixing protrusion is inserted, wherein the inner case further comprises a rear wall, wherein the ice making cover further comprises a second fixing protrusion parallel to the first fixing protrusion and spaced apart in a second direction perpendicular to a first direction in which the ice making cover is inserted toward the rear wall, and wherein the ice making case further comprises a second insertion hole disposed parallel to the first insertion hole, spaced apart in the second direction, and configured to receive the second fixing protrusion inserted thereinto.

2. The refrigerator of claim 1, wherein the ice making case further comprises a locking protrusion at an edge of the first insertion hole, and wherein the first fixing protrusion comprises a hooking member configured to be locked to the locking protrusion.

3. The refrigerator of claim 2, wherein the first fixing protrusion further comprises an insertion member protruding downward from the shelf member and configured to be inserted into the first insertion hole, and wherein the hooking member protrudes from the insertion member.

4. The refrigerator of claim 3, wherein the locking protrusion is provided on a front of the edge of the first insertion hole, wherein the hooking member protrudes in a forward direction from the insertion member, and wherein the forward direction is from an inside of the refrigerator and towards a door of the refrigerator.

5. The refrigerator of claim 3, wherein the locking protrusion is provided on a rear of the edge of the first insertion hole, wherein the hooking member protrudes in a backward direction from the insertion member, and wherein the backward direction is from an inside of the refrigerator and away from a door of the refrigerator.

6. The refrigerator of claim 1, wherein the shelf member is spaced apart from the ice making case.

7. The refrigerator of claim 1, wherein the shelf member comprises:

a support surface configured to support the item placed on the upper side; and an edge surface on an edge of the support surface, and wherein the support surface is recessed from the edge surface.

8. The refrigerator of claim 7, wherein the shelf member further comprises a stepped member between the support surface and the edge surface.

9. The refrigerator of claim 7, wherein the shelf member further comprises a guide rib protruding upward from the edge surface and disposed in front of the support surface.

10. The refrigerator of claim 1, wherein the ice making cover further comprises a rear inclined member extending from the shelf member toward the rear wall and inclined upward, wherein the rear inclined member covers a water supplier of the refrigerator, and wherein the water supplier is configured to supply water into the ice making case.

11. The refrigerator of claim 1, wherein the ice making cover further comprises a front inclined member extending from the shelf member to a front side and inclined downward.

12. The refrigerator of claim 1, wherein the ice making case further comprises a first locking protrusion provided on an edge adjacent to the first inner wall, wherein the first fixing protrusion comprises a first insertion member and a first hooking member, wherein the first insertion member extends downward from the shelf member and is configured to be inserted into the first insertion hole, and wherein the first hooking member is configured to be locked to the first locking protrusion and protrudes from the first insertion member toward the first inner wall.

13. The refrigerator of claim 1, wherein the ice making case further comprises a first locking protrusion on an edge adjacent to the second inner wall, wherein the first fixing protrusion comprises a first insertion member and a first hooking member, wherein the first insertion member extends downward from the shelf member and is configured to be inserted into the first insertion hole, and wherein the first hooking member is configured to be locked to the first locking protrusion and protrudes from the first insertion member toward the second inner wall.

14. A refrigerator comprising:

an outer case forming an exterior of the refrigerator;

an inner case comprising a first side wall and a second side wall facing to the first side wall; and an ice maker mounted on the inner case, configured to produce ice, and comprising an ice making case and an ice making cover covering an upper side of the ice making case, wherein the ice making case comprises a first insertion hole configured to couple to the ice making cover, and wherein the ice making cover is configured to support an item in the inner case and comprises a first fixing protrusion inserted into the first insertion hole, wherein the ice making cover comprises a shelf member, covering the ice making case, and the first fixing protrusion protrudes from the shelf member toward the ice making case, wherein the inner case further comprises a rear wall, wherein the ice making cover further comprises a second fixing protrusion parallel to the first fixing protrusion and spaced apart in a second direction perpendicular to a first direction in which the ice making cover is inserted toward the rear wall, wherein the ice making case further comprises a second insertion hole disposed parallel to the first insertion hole, spaced apart in the second direction, and configured to receive the second fixing protrusion inserted thereinto.

15. The refrigerator of claim 14, wherein the ice making case comprises a locking protrusion at a front of an edge of the first insertion hole, wherein the first fixing protrusion comprises an insertion member, inserted into the first insertion hole, and a hooking member protruding in a forward direction from the insertion member and locked to the locking protrusion, and wherein the forward direction is a direction from an inside of the refrigerator and towards a door of the refrigerator.

16. The refrigerator of claim 14, wherein the ice making case comprises a locking protrusion at a rear of an edge of the first insertion hole, wherein the first fixing protrusion comprises an insertion member, inserted into the first insertion hole, and a hooking member protruding a backward direction from the insertion member and locked to the locking protrusion, and wherein the backward direction is a direction from an inside of the refrigerator and away from a door of the refrigerator.

17. The refrigerator of claim 14, wherein the shelf member has a rectangular shape and is configured to support an item placed on an upper side, and wherein the shelf member comprises a guide rib protruded from the upper side.

18. A refrigerator comprising:

an outer case at an exterior of the refrigerator;

an inner case and comprising a first side wall and a second side wall facing to the first side wall;

an ice making case mounted on the inner case, configured to produce ice, and supported by the first side wall and the second side wall, the ice making case comprising a first fixing protrusion protruding upward; and an ice making cover configured to support an item placed on an upper side of the ice making cover, and covering an upper side of the ice making case, the ice making cover comprising a first insertion hole into which the first fixing protrusion is inserted, wherein the ice making cover comprises a shelf member, covering the ice making case, and the first fixing protrusion is protruding from the ice making case toward the shelf member, wherein the inner case further comprises a rear wall, wherein the ice making case further comprises a second fixing protrusion parallel to the first fixing protrusion and spaced apart in a second direction perpendicular to a first direction in which the first fixing protrusion is protruding from the ice making case toward the shelf member, wherein the ice making cover further comprises a second insertion hole disposed parallel to the first insertion hole, spaced apart in the second direction, and configured to receive the second fixing protrusion inserted thereinto.

* * * * *